US005979326A

United States Patent [19]

Ohinata

[11] Patent Number: 5,979,326

[45] Date of Patent: Nov. 9, 1999

[54] COLLAPSIBLE INK CONTAINER HAVING DISK SHAPED HANDLE AND INK SUPPLY SOURCE DEVICE ENCASING THE CONTAINER FOR PRINTERS

[75] Inventor: Yoshiharu Ohinata, Tokyo, Japan

[73] Assignee: Riso Kagaku Corporation, Tokyo, Japan

[21] Appl. No.: 08/925,477

[22] Filed: Sep. 8, 1997

[30] Foreign Application Priority Data

Sep. 9, 1996 [JP] Japan ..... 8-260334

[51] Int. Cl.[6] ..... B41J 2/175; B65D 1/32

[52] U.S. Cl. ..... 101/494; 347/86; 215/382; 222/92; 220/666

[58] Field of Search ..... 215/382; 222/92; 220/666; 206/446; 347/86; 346/140.1; 101/494

[56] References Cited

U.S. PATENT DOCUMENTS

| | | | |
|---|---|---|---|
| 4,187,511 | 2/1980 | Robinson | 347/7 |
| 4,435,099 | 3/1984 | Murahara | 346/140.1 |
| 4,456,134 | 6/1984 | Cooper . | |
| 5,187,498 | 2/1993 | Burger | 347/86 |
| 5,240,130 | 8/1993 | Osbakk . | |
| 5,329,294 | 7/1994 | Ontawar et al. . | |
| 5,377,875 | 1/1995 | Kock et al. . | |
| 5,511,686 | 4/1996 | Gallay . | |
| 5,631,681 | 5/1997 | Klaus et al. | 347/85 |
| 5,758,789 | 6/1998 | Shin et al. | 215/382 |
| 5,839,368 | 11/1998 | Ohinata | 101/335 |

FOREIGN PATENT DOCUMENTS

| | | |
|---|---|---|
| 25-3067 | 5/1925 | Japan . |
| A-59-37162 | 2/1984 | Japan . |
| A-59-37163 | 2/1984 | Japan . |
| 60-94275 U | 6/1985 | Japan . |
| A-62-3438 | 1/1987 | Japan . |
| 62-82977 | 5/1987 | Japan . |
| 5-82858 | 11/1993 | Japan . |
| 5-95878 | 12/1993 | Japan . |
| 6-199349 | 7/1994 | Japan . |
| A-6-199349 | 7/1994 | Japan . |
| 8-1959 | 1/1996 | Japan . |
| 8-260344 | 10/1996 | Japan . |
| A-9-39712 | 2/1997 | Japan . |
| WO 90 08698 | 8/1990 | WIPO . |
| WO 93 17918 | 9/1993 | WIPO . |
| WO 94 11194 | 5/1994 | WIPO . |

*Primary Examiner*—Edgar Burr
*Assistant Examiner*—Daniel J. Colilla
*Attorney, Agent, or Firm*—Oliff & Berridge, PLC

[57] ABSTRACT

To remarkably decrease the amount of material for the manufacture of ink containers and the volume of the ink containers after use, so as to contribute to the economy of natural resource consumption and solving the problem of destruction of global environment by the waste of products, without sacrificing the easiness of handling of the ink containers for printers, the ink container for directly storing ink is principally constructed by a thin walled vessel contractible according to discharge of ink therefrom, with a nozzle being connected to an end portion of the vessel, with a disk handle being mounted to the nozzle, so that the disk handle can be grasped by five fingers of a hand for carrying the ink container by hand and for removing a cap therefrom. For the ink container being housed in a printer, the ink container is charged into a reinforcing case with the nozzle and the disk handle engaged with an end wall portion of the case, so that the ink container is handled like the case.

11 Claims, 19 Drawing Sheets

COLLAPSIBLE INK CONTAINER HAVING DISK SHAPED HANDLE AND INK SUPPLY SOURCE DEVICE ENCASING THE CONTAINER FOR PRINTERS

BACKGROUND OF THE INVENTION

1. Field of the Invention

The present invention relates to the art of printer, and more particularly, to an ink container to serve as an ink supply source of a printer and an ink supply source device incorporating such an ink container.

2. Description of the Prior Art

In a printer for automatically continuously printing a large number of prints such as a rotary type stencil printer, the ink consumed according to the progress of printing is continuously supplied from an ink container charged in the printer. As an ink container for this purpose there is known an ink container having a circular cylinder portion of a circular cross section, an end plate member mounted into the cylinder from one end thereof so as to be able to slide along the central axis of the cylinder like a free piston, and an annular end wall closing the other end of the cylinder except a central opening, and a nozzle connected to the central opening, the inside of the cylinder being initially filled with ink with the end plate positioned at the one end, wherein the end plate moves axially in the cylinder toward the other end as the ink in the cylinder is drawn out through the nozzle. (Japanese Patent Laid-open Publication 59-37162) When a printer is operated with an ink container of this construction, the resistance against the drawing out of the ink from the ink container remains always constant regardless of the amount of ink remaining in the container, whereby a large number of prints are available at a continuously stabilized density.

In the ink container of the above-mentioned construction, since the cylinder portion must operate not only as a wall means of a container for storing ink but also as a cylinder member for smoothly guiding the end plate member along the inside wall thereof like a free piston, the cylinder portion forming a principal portion of the ink container must have such a wall thickness that provides a high rigidity enough to operate as a cylinder for guiding a free piston therein, and therefore, a substantial amount of a material such as a synthetic resin or the like is required for the manufacture of the ink container, and further, the used ink container presents substantially the same outer configuration as that in its initial stage, although the end plate member is shifted to the deepest position of the cylinder to be close to the nozzle. Therefore, when the number of used ink containers increases according to the working hour of the printer, a difficulty should arise about the disposal of the used ink containers.

It is well known from old days to construct a fluid storing container to have a bellows construction. Particularly in Japanese Utility Model Application 60-94275 (Laid-open Publication 62-3438), there is proposed a container having a cylindrical portion of a bellows construction having a closed one end and another end having an opening, and a nozzle connected to the opening. Further, it is shown in Japanese Patent Laid-open Publication 6-199349 to construct a bellows type ink container for a printer such that an inner cylinder of a bellows construction projects from an end of a main cylinder portion toward the inside thereof, such that the amount of ink which remains in the ink container after the end of possible discharge of ink therefrom is decreased.

Further, in Japanese Patent Application 9-39712, there is proposed an ink container comprising a vessel constructed from a bag made of a flexible sheet and collapsible to be flat, a nozzle connected to one end of the vessel, and a cylinder member made of a relatively hard sheet material collapsible to be flat, the cylinder member covering a half or nearly the whole length of the bag, wherein the container is inflated to a cylindrical configuration by ink being charged therein.

However, when such a container having a bellows construction or made of a flexible sheet is constructed to have a very thin wall thickness, the cylindrical container formed by the inflation thereof by a charge of ink therein is difficult for seizure by fingers as it readily flattens by the application of pressing forces by the fingers, so as to release the pressing forces, thereby nullifying the seizing function by the fingers. When the container has a simple cylindrical configuration with no bellows, an effective seizure by fingers is more difficult than in a container having bellows. When it is only needed that the container is hung up, a cap mounted to the nozzle may be grasped by tips of fingers. However, when the container filled with ink is charged into a printer, the cap must be removed. In order to remove the cap tightly clamped not to cause a leakage of ink, the cylindrical portion of the container must be firmly held. If a firm holding is not available, it will be very difficult to remove the cap. Further, if the cap is removed by clamping the flexible cylinder portion, at a moment when the cap was removed, the ink will be inadvertently ejected out from the container.

SUMMARY OF THE INVENTION

In view of the relatively large amount of material needed for the manufacture of the conventional rigid type ink containers and the difficulty in disposing of the used containers, and in consideration of the substantial loss of handiness of the ink containers when the wall thickness thereof is decreased for the economy of natural resources and the resolution of the problem of disposal of the used containers, it is a first object of the present invention to provide an ink container for a printer by which those problems are resolved.

Further, in order for the ink container not to be inferior with respect to easy handling by hands as compared with the conventional rigid ink container in charging and discharging it into and out of a printer, it is a second object of the present invention to provide a device to be combined with the ink container for providing a convenient ink source supply device for a printer.

According to the present invention, the above-mentioned first object is accomplished by an ink container comprising a flexible vessel expansible to be substantially cylindrical by ink being charged therein and contractible to substantially reduce an outer configuration thereof by the ink being discharged therefrom, a nozzle connected to an end portion of said vessel for defining an ink outlet port of said vessel, and a disk handle mounted to said nozzle.

Further, according to the present invention, the above-mentioned second object is accomplished by an ink supply source device for a printer assembled from an ink container comprising a flexible vessel expansible to be substantially cylindrical by ink being charged therein and contractible to substantially reduce an outer configuration thereof by the ink being discharged therefrom, a nozzle connected to an end portion of said vessel for defining an ink outlet port of said vessel, and a disk handle mounted to said nozzle, and a reinforcing case for receiving at least said vessel of said ink container.

According to the present invention, the disk handle mounted to the nozzle provides a means for easily applying a reaction force to the nozzle against a force for removing a cap mounted to the nozzle when the cap is removed from the nozzle. Since such a handle means is in the shape of a disk, the same shape of handle is always available regardless of the rotational posture of the ink container. Of course the disk handle not only operates at the time of removing the cap but also provides a convenient means for handling the ink container such that it can be grasped by five fingers of a hand.

Further, by the ink container of the present invention being combined by the reinforcing case which accommodates at least the vessel of the ink container when it is charged into a printer, only one reinforcing case can serve for all ink containers used for the printer in succession, and therefore the volume of the disposal generated after the consumption of ink is contracted to a very small volume occupied substantially by the contracted vessels made of a very small amount of synthetic resin, while providing the convenience that the charging and discharging of the ink supply source device into and out of a printer are always done with the reinforcing case.

Although the disk handle mounted to the nozzle has a function of substantially facilitating the removal of the cap and the handling of the ink container by hands when the ink container is viewed as an independent article, when the ink container equipped with the disk handle is combined with the reinforcing case to provide an ink supply source device for a printer, the disk handle functions also as a means for most definitely specifying a predetermined position of the ink container housed in the reinforcing case. In other words, when the ink container is housed in the case, the disk handle presents a relatively rigid disk body at a position close to one end of the container. Therefore, whether or not the ink container was correctly charged into a printer at a predetermined position with its nozzle being correctly positioned relative to the ink drawing means of the printer is detected by letting a feeler of an appropriate contact detection device touch the disk handle, whereby the correct positioning of the nozzle of the ink container relative to the ink drawing means is easily and precisely detected.

In this connection, when the disk handle is exposed out of the reinforcing case, the feeler of the contact detection device can directly contact the disk handle. When the disk handle is housed in the reinforcing case, the case may be formed of an opening at a portion thereof opposing the disk handle, so that the feeler of the contact detecting device mounted in a printer can touch the disk handle through the opening. In this case, a correct touching of the feeler through the opening confirms that the case was correctly charged into the printer together with the confirmation that the ink container is correctly housed in the printer.

Alternatively, the disk handle may be provided with a projection, while the case is formed with an opening which allows the projection to project therethrough out of the case when the ink container was correctly housed in the case, so that the projection projected out of the case is detected by the feeler of a contact detection device mounted in a printer. By such a construction, it is confirmed that the case was first correctly charged with the ink container and thereafter correctly charged into the printer.

When the case is constructed to have two half cylindrical case halves and a hinge for relatively pivotably connecting the two case halves along a longitudinal edge of each of the case halves adjacent to each other, the case is reformed between an open state widely exposing the inside thereof for charging and discharging the ink container into and out of the case and a closed state housing the ink container therein. Further, when the case is so constructed that the two case halves are relatively pivotably connected by the hinge, an axial end wall of the case through which the nozzle of the ink container is passed may be constructed by two openable arcuate end walls, so that the inner arcuate edges of the arcuate end walls are engaged into between the disk handle and an end wall of the vessel opposing thereto, thereby determining the axial position between the case and the ink container. Alternatively, the nozzle of the ink container may be formed with at annular groove adapted to receive the arcuate inner edges of the arcuate end walls when the case halves are closed together. When such an annular groove is formed, the nozzle of the ink container is axially locked relative to the case even when the disk handle is housed within the case.

Alternatively, provided that vessel of the ink container has a substantially circular cross section, the reinforcing case may be constructed to have a trough portion to receive more than a half of the circular cross section of the vessel and a dish shaped or annular end wall portion adapted to receive a closed end of the ink container.

By the case being constructed to have such a trough portion adapted to receive more than a half of the vessel having a circular cross section, when the ink container was charged into the trough portion, the opposite side edges of the trough portion hold the ink container so as to automatically retain the ink container in the housed position.

The disk handle may be formed integrally with the nozzle, or the disk handle may be formed separately from the principal portion of the ink container including the nozzle and may be fastened to the nozzle by thermal welding, adhesive or mechanical fastening means employing a screw ring or a spline member.

BRIEF DESCRIPTION OF THE DRAWINGS

In the accompanying drawings.

DESCRIPTION OF THE EMBODIMENTS

In the following, the present invention will be described in more detail with respect to some preferred embodiments with reference to the accompanying drawings.

Figure 1:
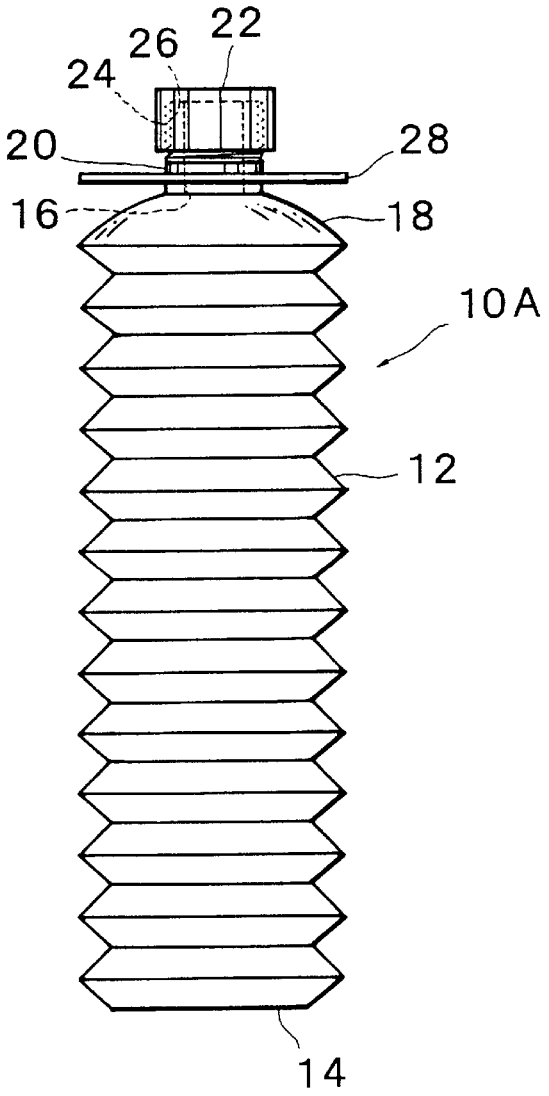
FIG. 1 is a side view showing a first embodiment of the ink container according to the present invention together with a cap.
Figure 2:
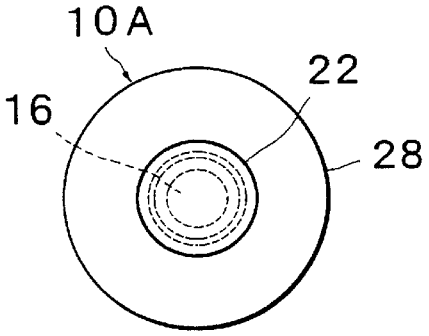
FIG. 2 is a plan view of the capped ink container shown in FIG. 1.
Figure 3:
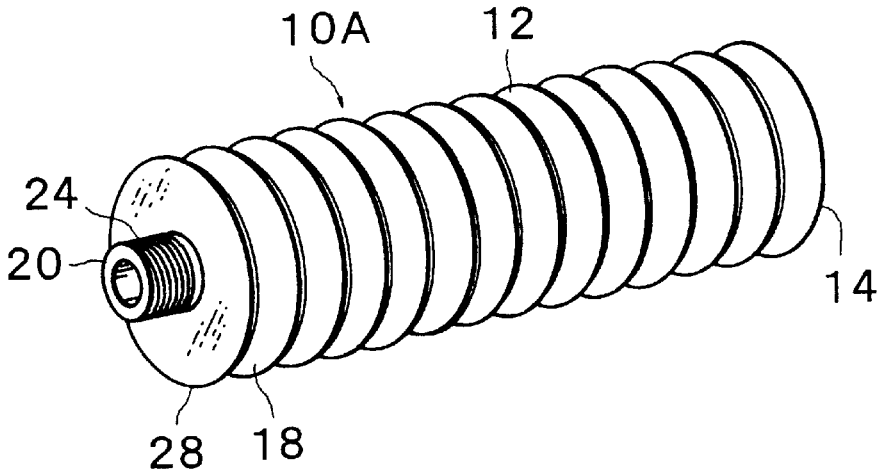
FIG. 3 is a perspective view of the ink container shown in FIGS. 1 and 2.

Referring to FIG. 1 showing a side view of an embodiment of the ink container according to the present invention constructed to have the vessel of a bellows construction, the ink container bearing a cap mounted thereto, FIG. 2 showing a plan view of the capped ink container shown in FIG. 1, viewed from an upper position of FIG. 1 axially downward, and FIG. 3 showing a perspective view of the ink container shown in FIGS. 1 and 2, the ink container generally designated by 10A includes a vessel made of a cylindrical portion 12 of a bellows construction, an end wall portion 14 closing one end (lower end in FIG. 1) of the cylindrical portion and an annular end wall portion 18 extending from the other end (upper end in FIG. 1) of the cylindrical portion to a central opening 16, and a cylindrical nozzle 20 connected to the central opening 16. In the conditions shown in FIGS. 1 and 2, a cap 22 is mounted around the open end of the nozzle 20. In this embodiment, the cap 22 is fastened by the engagement of male threads 24 formed around the tip end portion of the nozzle 20 and female threads 26 formed along the inside of the cap, so as to close the tip opening of the nozzle. The cap 22 is provided to hold an ink charged condition of the ink container, and is removed from the nozzle 20 prior to the use of the ink container. The time desirable for removing the cap will be described later.

A disk handle 28 is mounted to the nozzle 20. It is desirable that the disk handle 28 has a diameter substantially the same as that of the cylindrical portion 12 as in the shown embodiment. The thickness of the disk handle should desirably be such that the disk handle exhibits a substantially rigid annular body. The disk handle 28 is mounted to a root portion of the nozzle 20, i.e. adjacent to the connection portion between the nozzle 20 and the annular end wall portion 18, so as to hold an end wall portion of the reinforcing case between the disk handle and the annular end wall portion of the ink container, as described later.

Although it was described in the above that the ink container 10A has cylindrical portion 12, a closed end wall portion 14 and an annular end portion 18, that the nozzle 20 is connected to the annular end wall portion 18, and that the disk handle 28 is connected to the nozzle 20, these descriptions are for the explanation of the respective portions of the ink container. The cylindrical portion 12, the end wall portions 14 and 18, the nozzle 20 and the disk handle 28 may be formed to be all integral by a single material, particularly a soft synthetic resin. In this case, the cylindrical portion 12 of a bellows construction forming a principal portion of the ink container is made to have a necessary minimum thickness to function as an ink storing container, so that the material is saved as much as possible and the mass and the volume to be disposed after the consumption of the ink is suppressed to a minimum. The thickness of the end wall portions 14 and 18 may be of the same order as that of the cylindrical portion 12. However, since a certain rigidity is required for the annular end wall portion 18, it is desirable that the annular end wall portion 18 is formed to have spherical construction as in the shown embodiment, so that its rigidity is increased relative to its thickness. The rigidity of the annular end wall portion 18 may be given by a provision of appropriate ribs in place of or in addition to the spherical construction. The bellows of the cylindrical portion 12 may be constructed to retain the contracted stage by itself, as shown in the above-mentioned Japanese Patent Laid-open Publication 6-199349. Further, the end wall portion 14 may be provided with an inside bellows cylinder for decreasing the amount of ink remaining after the use, as also shown in said publication.

Further, instead of being formed integrally with the nozzle 20, the disk handle 28 may be formed separately from the principal portion of the ink container including the nozzle 20 and mounted to the nozzle 20 by thermal welding, adhesive, or a screw ring or a spline engagement, as described with respect to an embodiment described later.

As described above, it is desirable that the cylindrical portion 12 of a bellows construction is made to have a minimum thickness necessary to function as an ink storing container. Even when such a bellows construction is made to have a thin wall of a soft synthetic resin, when ink is filled therein, with the open end of the nozzle 20 being sealed by the cap 22, the ink, an incompressible fluidal material, maintains a constant volume by itself, so that, in spite of a relatively high flexibility of the bellows construction having a thin wall thickness, the bellows shape of the cylindrical portion 12 does not substantially change if the ink container is suspended at the nozzle 20 positioned at the upper end of the ink container for transportation.

Since the disk handle 28 is mounted to the nozzle 20 according to the present invention, taking out of the ink container from a storing box and charging thereof into a printer are readily done by grasping the ink container at the disk handle 28 by five fingers of a hand.

Figure 4:
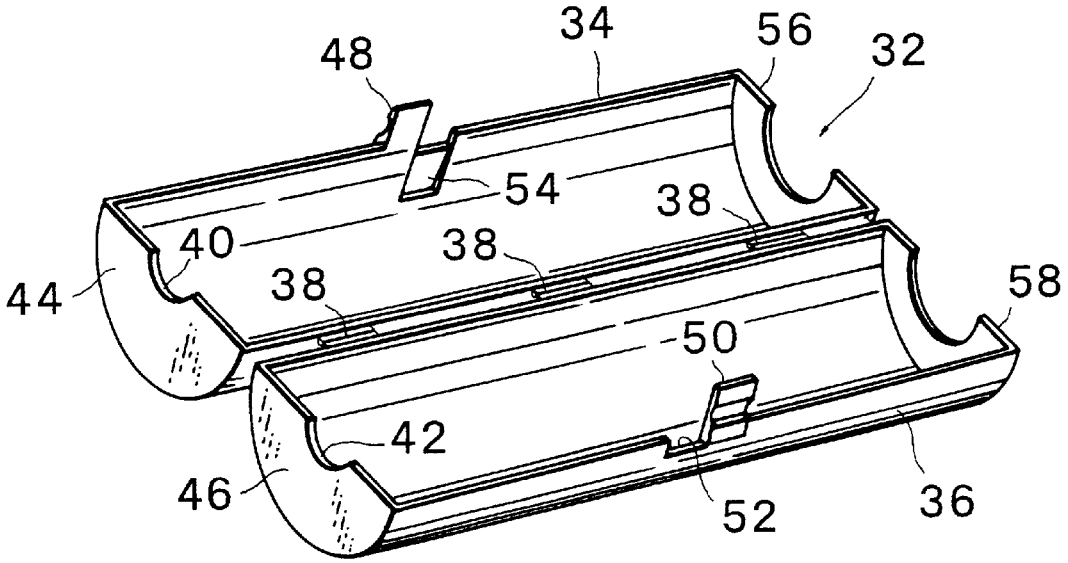
FIG. 4 is a perspective view showing a first embodiment of the case according to the present invention with a case half being opened.
Figure 5:
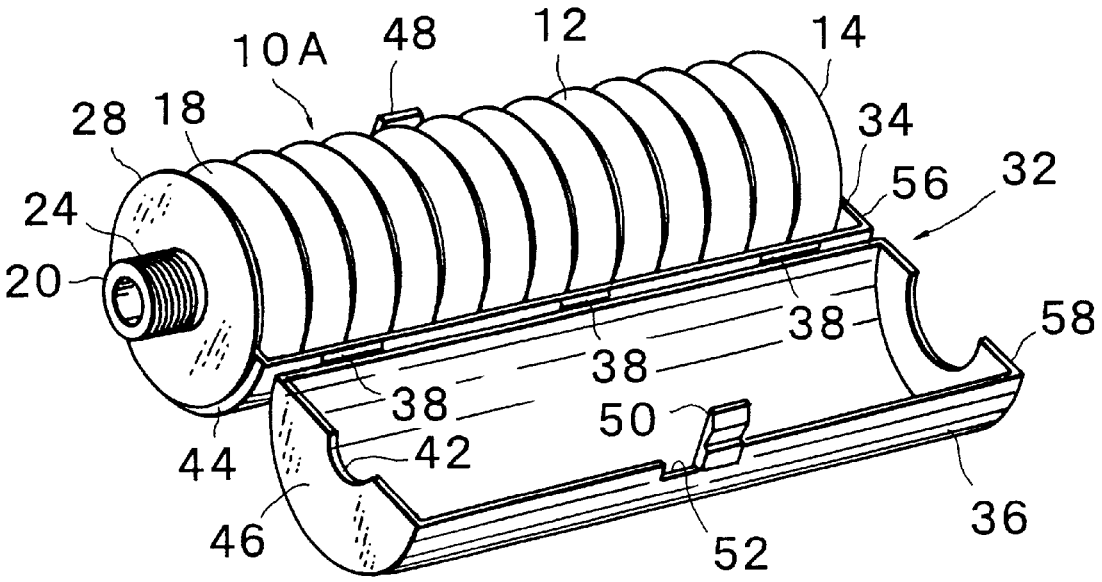
FIG. 5 is a perspective view showing the ink container shown in FIG. 3 as placed in the case in the state shown in FIG. 4.
Figure 6:
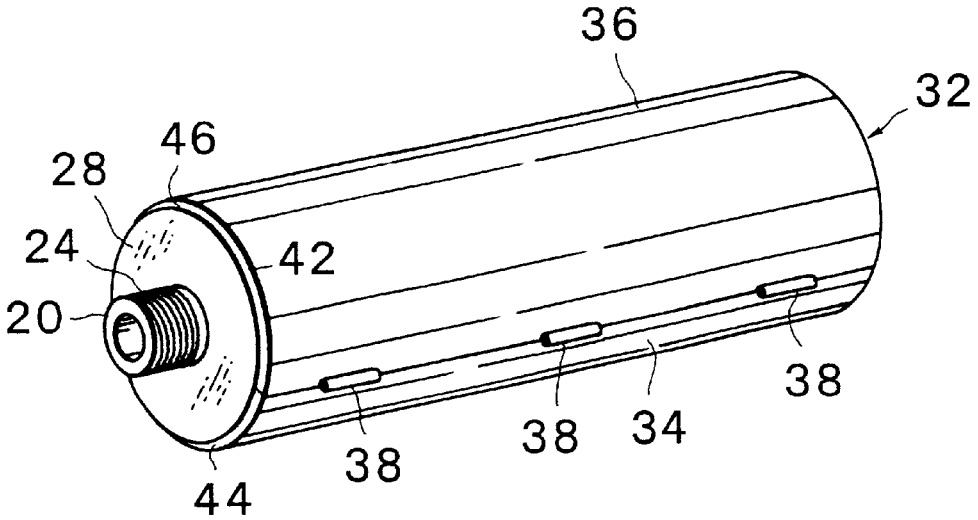
FIG. 6 is a perspective view showing the case of FIG. 4 with the ink container of FIG. 3 completely housed therein.

FIG. 4 is a perspective view of an embodiment of a reinforcing case adapted to be combined with the ink container for charging the ink container into a printer with higher easiness and precision, FIG. 5 is a perspective view showing a stage of housing the ink container in the case, and FIG. 6 is a perspective view of the case in the condition where the housing of the ink container therein has been completed. It is desirable that the cap 22 is removed from the ink container 10A after the cylindrical portion 12 of the ink container has been settled in the case as shown in FIG. 5. For removing the cap, the disk handle 28 may be held by one end.

In these figures, the case generally designated by 32 presents a cylindrical configuration of a circular cross section in the state of use. However, in the shown embodiment, the case is constructed from two case halves 34 and 36 into which the cylinder is separated by a phantom plane including the central axis of the cylinder, and hinge 38 for connecting the two case halves to be pivotable relative to one another along a longitudinal edge of each of the case halves adjacent to one another. In the shown embodiment, the hinge 38 is separated into three pieces. The case halves 34 and 36 are shaped just to enclose the cylindrical portion 12 of a bellows construction of the ink container 10A when they are closed together into a cylindrical configuration.

In the shown embodiment, the case halves 34 and 36 have half circular end wall portions 44 and 46 formed with half circular notches 40 and 42, respectively, for passing the nozzle 20 of the ink container therethrough. When the ink container 10A is housed in the case half 34 as shown in FIG. 5, the edge portion of the half circular notch 40 engages along a half section of the nozzle 20 at a position between the end wall portion 18 and the disk handle 28. And then, when the case half 36 is closed onto the case half 34 as shown in FIG. 6, the edge portion of the half circular notch 42 engages the opposing the edge portion of the notch 40, so as to coaxially align the nozzle 20 of the ink container relative to the case, while specifying the axial position of the ink container relative to the case, with maintenance of the axial relative position. The case halves 34 and 36 are formed with elastic engaging tongues 48 and 50, respectively, which are adapted to elastically meet with engaging grooves 52 and 54 formed in the other of the case halves, respectively, so as to maintain the cylindrically closed state of the case halves. In the shown embodiment, the case halves 34 and 36 are formed with half annular end wall portions 56 and 58 at the other ends thereof, respectively.

Figure 7:
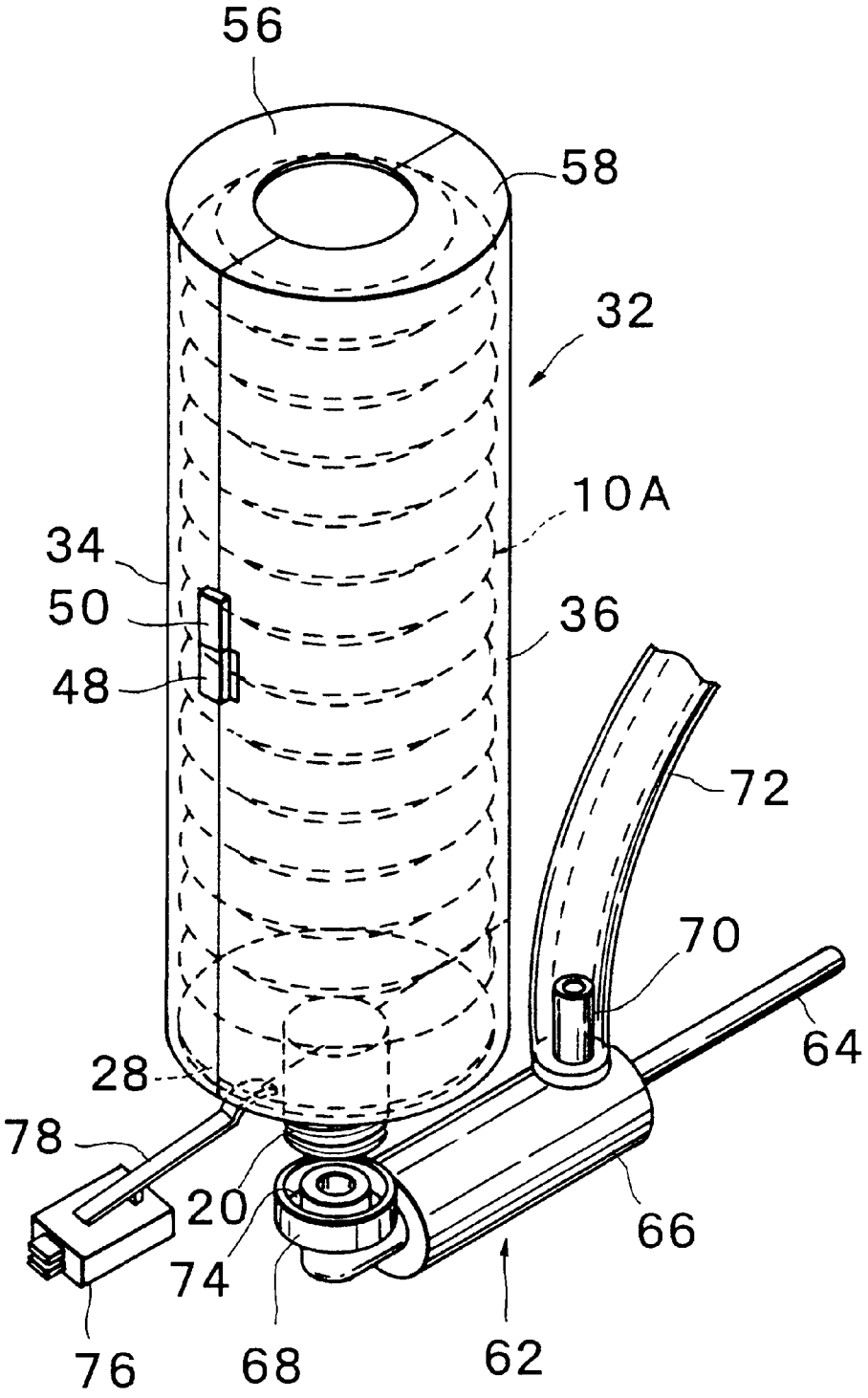
FIG. 7 is a perspective view showing the case housing the ink container therein as shown in FIG. 6 as mounted to the ink drawing means.

As shown in FIG. 7, the ink drawing means 62 of the printer includes a cylinder means 66 incorporating therein a helical ink drawing pump mechanism (not shown) adapted to be rotationally driven by a rotary shaft 64, an ink drawing head 68 provided at one end of the cylinder means, and an ink delivery port 70, and is so adapted that the nozzle 20 of the ink container is engaged with the ink drawing head 68, the pump mechanism is operated by the rotary shaft 64, and the ink drawn out from the ink container 10A is pumped out from the delivery port 70 to be conducted through a conduit 72 connected thereto toward the printing drum of the printer.

Although in FIG. 7 the nozzle 20 of the ink container is shown in a state slightly removed from the ink drawing head 68 for the purpose of clarity of illustration, when the ink container 10A and the case 32 housing the ink container have been completely positioned relative to the ink drawing means 64, the tip end of the nozzle 20 is tightly engaged into an annular groove 74 of the ink drawing head 68, and in such a state the disk handle 28 of the ink container is just touched by a feeler 78 of a contact detection device 76, so that the regular positioning of the ink container is thereby detected.

FIGS. 8–13 are views similar to FIGS. 1–7, showing a second embodiment of the present invention, wherein the first embodiment described above is modified at a portion thereof In FIGS. 8–13, the portions corresponding to those shown in FIGS. 1–7 are designated by the same reference numerals and function in the same manner as in the embodiment shown in FIGS. 1–7.

In the second embodiment, the nozzle 20 is formed with an annular groove 30 at a position on the tip end side of the disk handle 28, and an ink container 10B is so adapted so as to be housed in a case 32' with the disk handle 28 positioned at the inside of the case 32', such that the half circular notches 40 and 42 of the case engage the annular groove 30.

Figure 13:
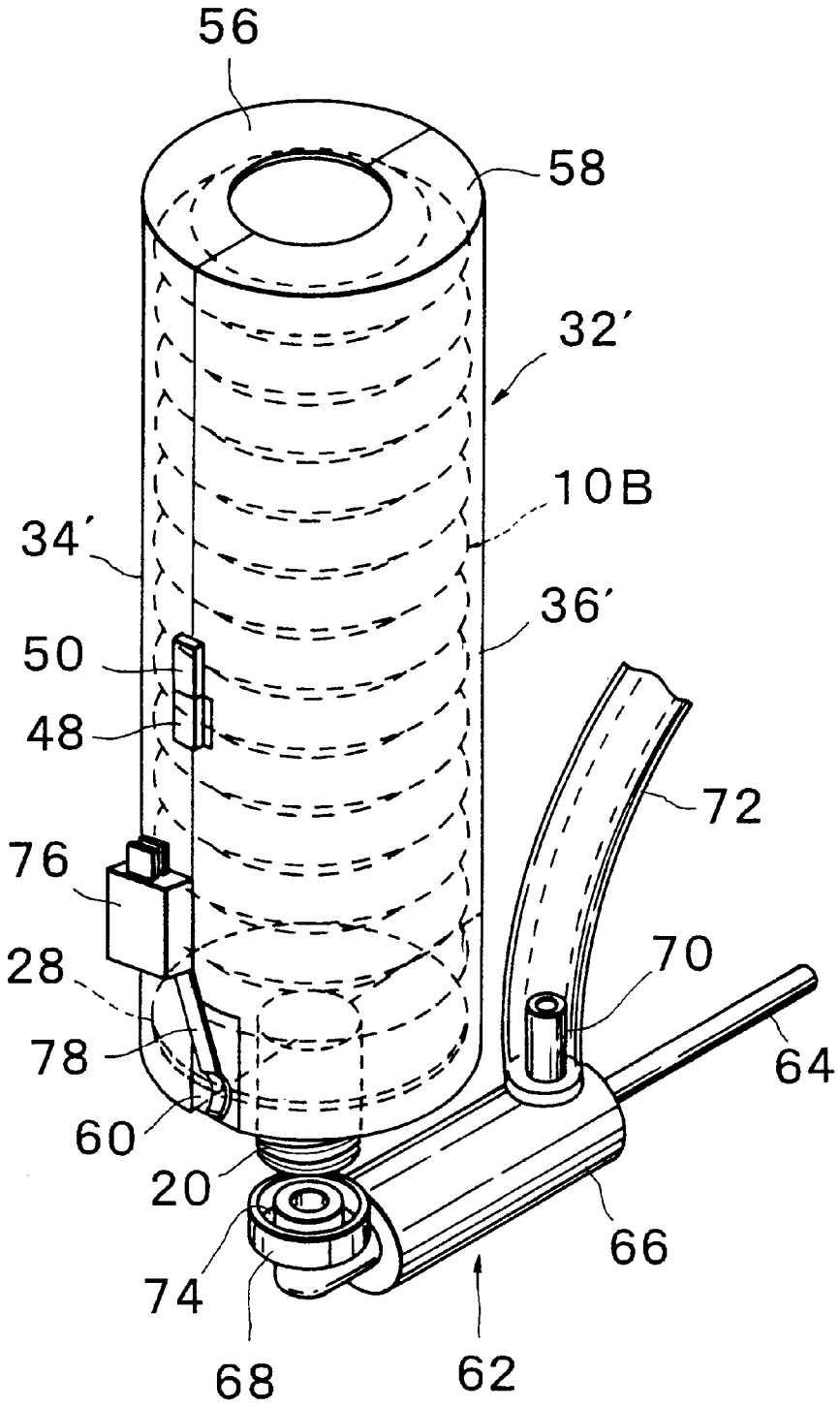
FIG. 13 is a perspective view showing the case housing the ink container therein as shown in FIG. 12 as mounted to an ink drawing means.
Figure 14:
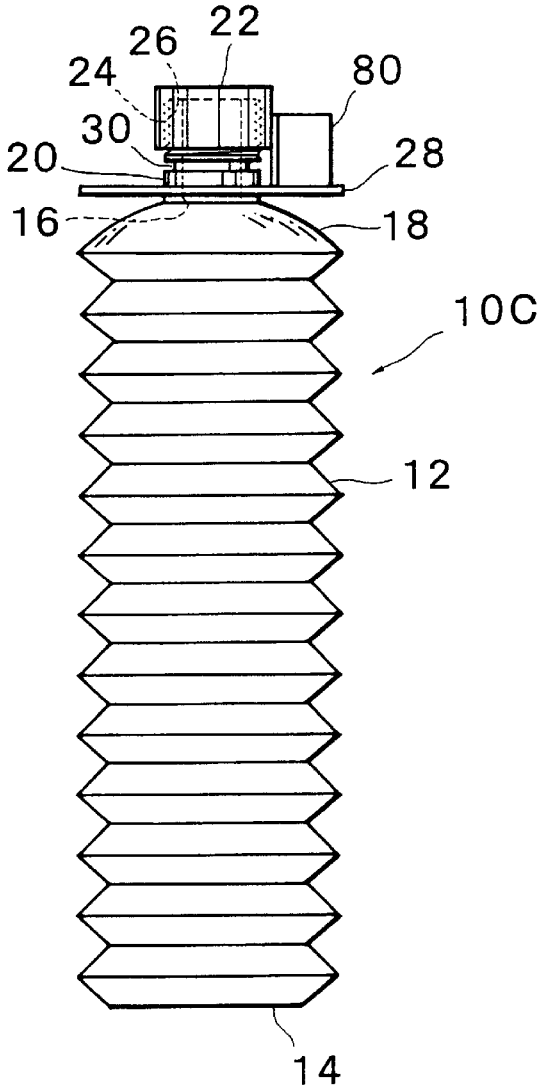
FIG. 14 is a side view of a third embodiment of the ink container according to the present invention together with a cap.
Figure 15:
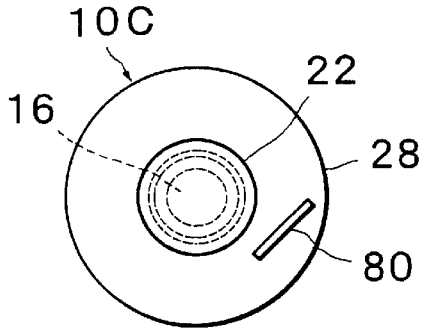
FIG. 15 is a plan view of the capped ink container shown in FIG. 14.
Figure 16:
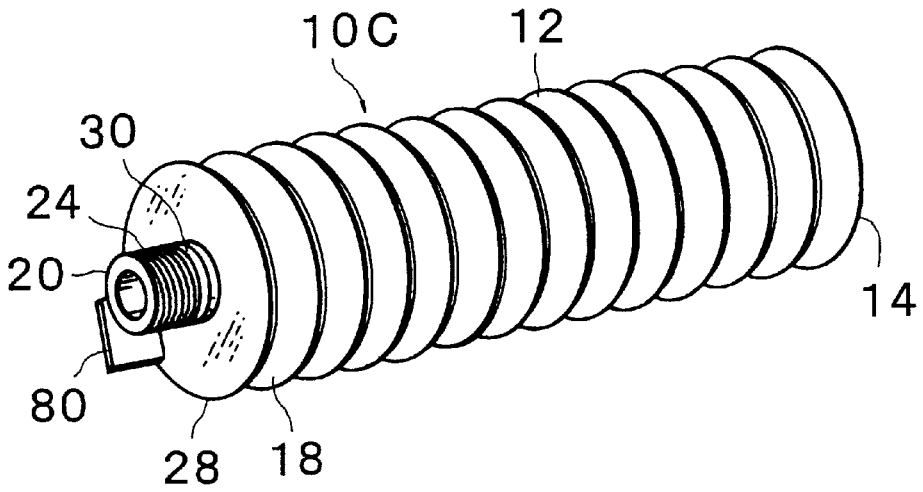
FIG. 16 is a perspective view of the ink container shown in FIGS. 14 and 15.
Figure 17:
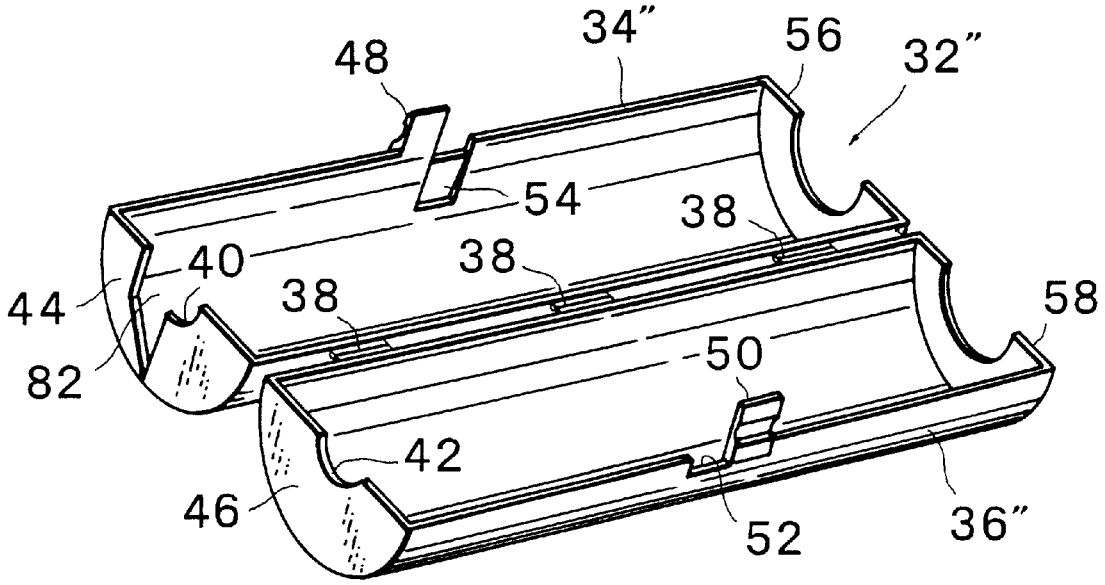
FIG. 17 is a perspective view showing a third embodiment of the case according to the present invention with a case half thereof being opened.
Figure 18:
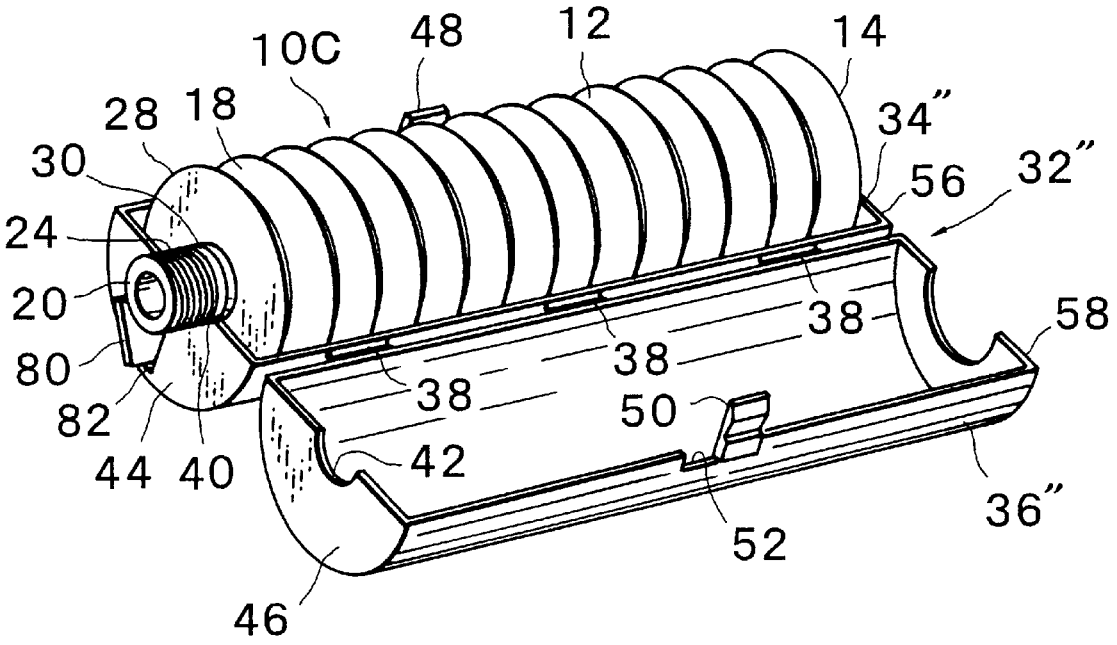
FIG. 18 is a perspective view showing the ink container shown in FIG. 16 as placed in the case in the stage shown in FIG. 17.

The case half 36' is formed with a notch 60 at a portion thereof including a part of the end wall portion 46 and a part of the half cylindrical wall portion adjacent thereto. This notch exposes the disk handle 28 toward the outside of the case 32' for allowing a contact detection thereof from the outside of the case for detecting that the nozzle 20 of the ink container was correctly positioned relative to the ink drawing means 62 of the printer when the ink container 10B was charged into the printer as shown in FIG. 13. As is apparent from the figures, only when the case 32' correctly housing the ink container 10B therein was correctly positioned relative to the ink drawing means 62 of the printer with respect to the rotational position as well as the axial position thereof, the disk handle 28 correctly biases the feeler 78 of the contact detection device 76 so that the regular charging of the ink container relative to the ink drawing means is duly detected thereby.

FIGS. 14–20 are views similar to FIGS. 8–13, showing a third embodiment of the present invention which is a partial modification of the second embodiment described with respect to FIGS. 8–13. In FIGS. 14–20, the portions corresponding to those shown in FIGS. 8–13 are designated by the same reference numerals and function in the same manner as in the embodiment shown in FIGS. 8–13.

Figure 19:
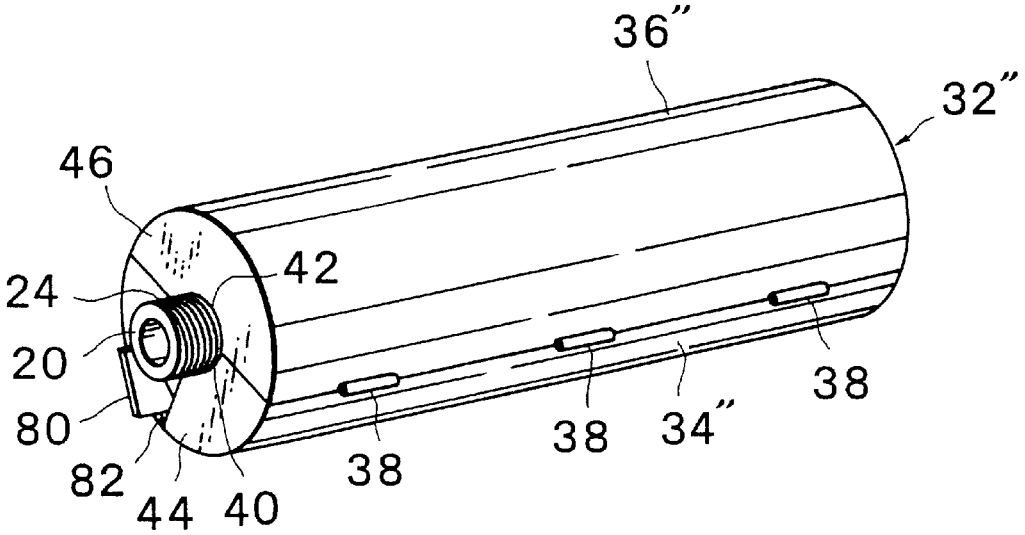
FIG. 19 is a perspective view showing the case of FIG. 17 with the ink container of FIG. 16 completely housed therein.

In this third embodiment, the disk handle 28 of an ink container 10C is provided with a projection 80 extending in the axial direction therefrom as shown in the figures, and corresponding thereto the case half 34" of a case 32" is formed with a notch 82 for receiving the projection 80 when the ink container was correctly housed in the case half. In the shown embodiment, the notch 82 is formed to partly overlap the half circular notch 40, so that the half circular notch 40 is partly canceled. Also in this embodiment, when the ink container 10C is correctly housed in the case 32" as shown in FIG. 19 through the state shown in FIG. 18, the annular groove 30 of the ink container 10C is engaged by the half circular edges of the end wall portion of the case so that thereby the axial relative position between the ink container and the case is determined, and the rotational position of the ink container 10C relative to the case 32" is determined by the engagement of the projection 80 with the notch 82.

Figure 20:
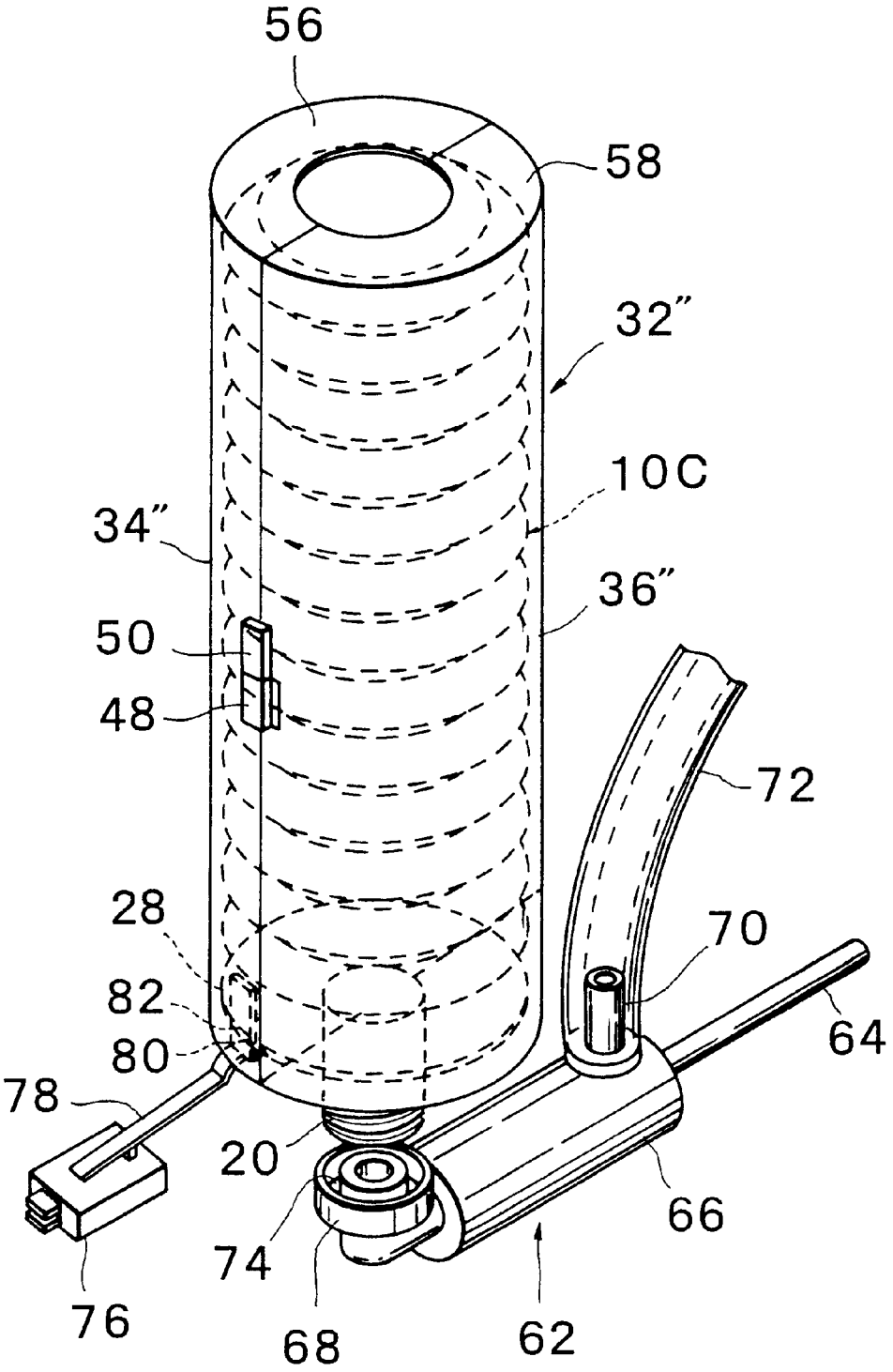
FIG. 20 is a perspective view showing the case shown in FIG. 19 with the ink container completely housed therein as mounted to an ink drawing means.

Thus, as shown in FIG. 20, the combination of the ink container and the case having the projection 80 projecting out of the end wall of the case is mounted relative to the ink drawing means 62 of the printer in the same manner as in the first and second embodiments. In this case, when the case 32" correctly housing the ink container 10C therein was correctly positioned relative to the ink drawing means 62 with respect to the rotational and axial positioned thereof, the tip end of the projection 80 is regularly detected by the feeler 78 of the same kind of sensor 76 as in the first or second embodiment.

In each construction shown in FIGS. 13 or 20, an appropriate guide means may be provided for guiding the case housed in the ink container to be in a predetermined correct position relative to the ink drawing means 62 of the printer with respect to the rotational position as well as the axial position thereof. For this purpose an appropriate engaging means such as a rib or the like may be provided on the case so as to be engaged and guided by an appropriate guide means provided in the printer. Although no examples of such guide means are shown in the figure, various means for such a guiding purpose will be embodied within a known art.

Figure 21:
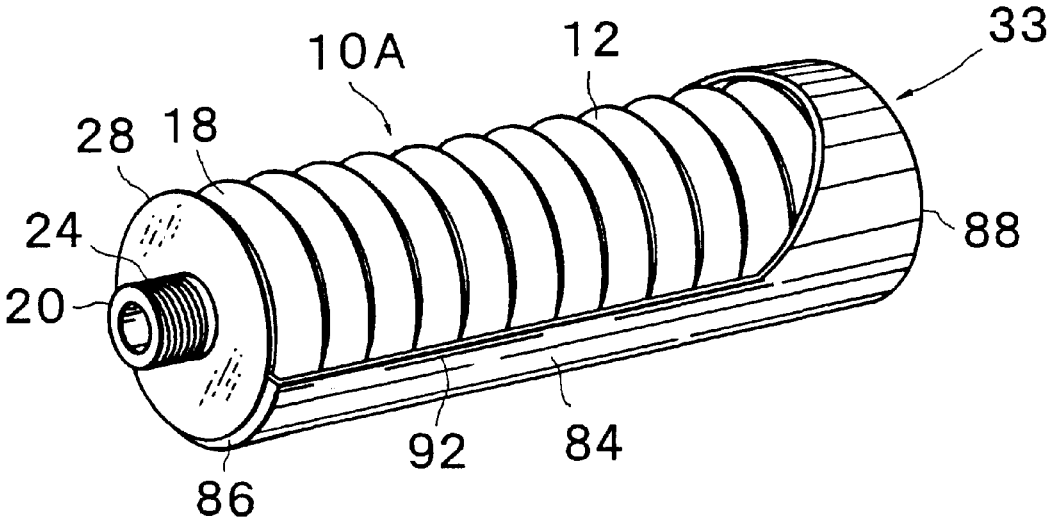
FIG. 21 is a perspective view showing a fourth embodiment of the case according to the present invention together with an ink container housed therein.
Figure 22:
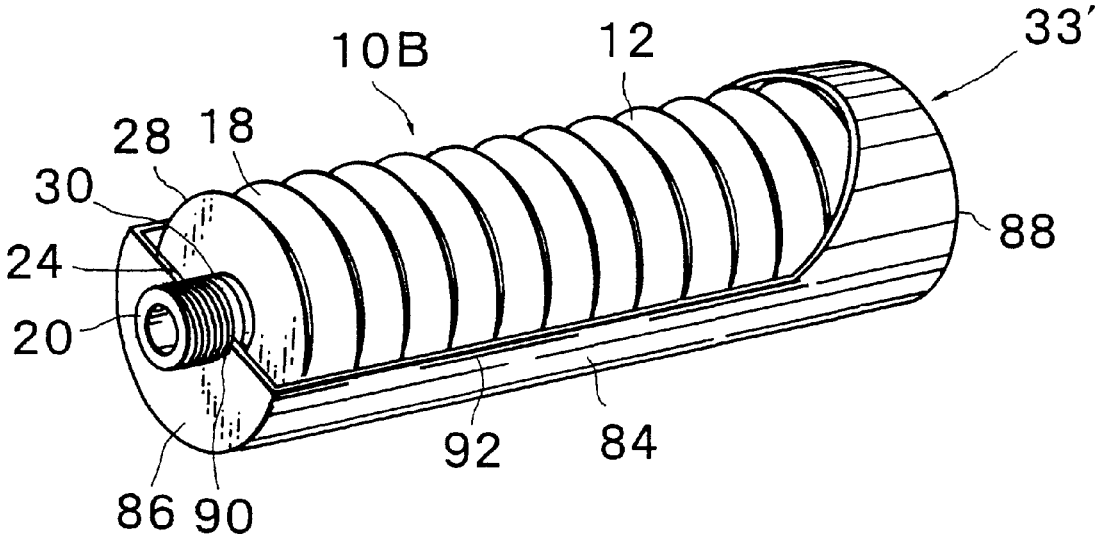
FIG. 22 is a perspective view showing a fifth embodiment of the case according to the present invention together with an ink container housed therein.

In the three embodiments described above, the reinforcing case was constructed as a cylindrical case having a circular cross section assembled from two case halves. However, the reinforcing case may be constructed as a trough-shaped case as shown in FIGS. 21 or 22. In these embodiments, each of the cases 33 and 33' has a trough portion 84 having an arcuate cross section extending over more than a half of the circular cross section of the ink container 10A or 10B separated into two halves along a phantom plane including the central axis of the ink container 10A or 10B and adapted to receive more than the half of the container 10A or 10B, an arcuate end wall portion 86 damming up one end of the trough portion, and an end wall portion 88 damming up the other end of the trough portion in the manner of receiving the corresponding end portion of the ink container 10A or 10B around the whole circumference thereof. The end wall portion 88 may be shaped like a dish or an annulus having a central circular opening. The arcuate end wall 86 is formed with an U-shaped edge 90 made by a combination of the half circular notch 40 corresponding to that of the above-mentioned three embodiments and two parallel edges (though not seen in FIG. 21), so that when the ink container 10A or 10B was housed in the case, the edge 90 engages with the nozzle 20 at a position between the disk handle 28 and the end wall portion 18 of the ink container or the annular groove 30 formed in the nozzle 20.

In this case, since the trough portion 84 receives the ink container 10A or 10B at a portion thereof larger than a half thereof separated by a phantom plane including the central axis thereof, opposite side edge portions 92 (only one of them being seen in FIGS. 21 and 22) are inclined to approach one another so as to hold the ink container 10A or 10B in a retaining manner. Therefore, when the ink container 10A or 10B is placed into the case such that the rear end portion thereof is first engaged into the end wall portion 88 from the inside thereof and then the nozzle or the circular groove 30 engage with the U-shape edge 90 deep enough to engage the half circular portion thereof, as shown in FIGS. 21 and 22, the housing of the ink container in the case is stably held by the holding action of the opposite side edges 92.

Figure 23:
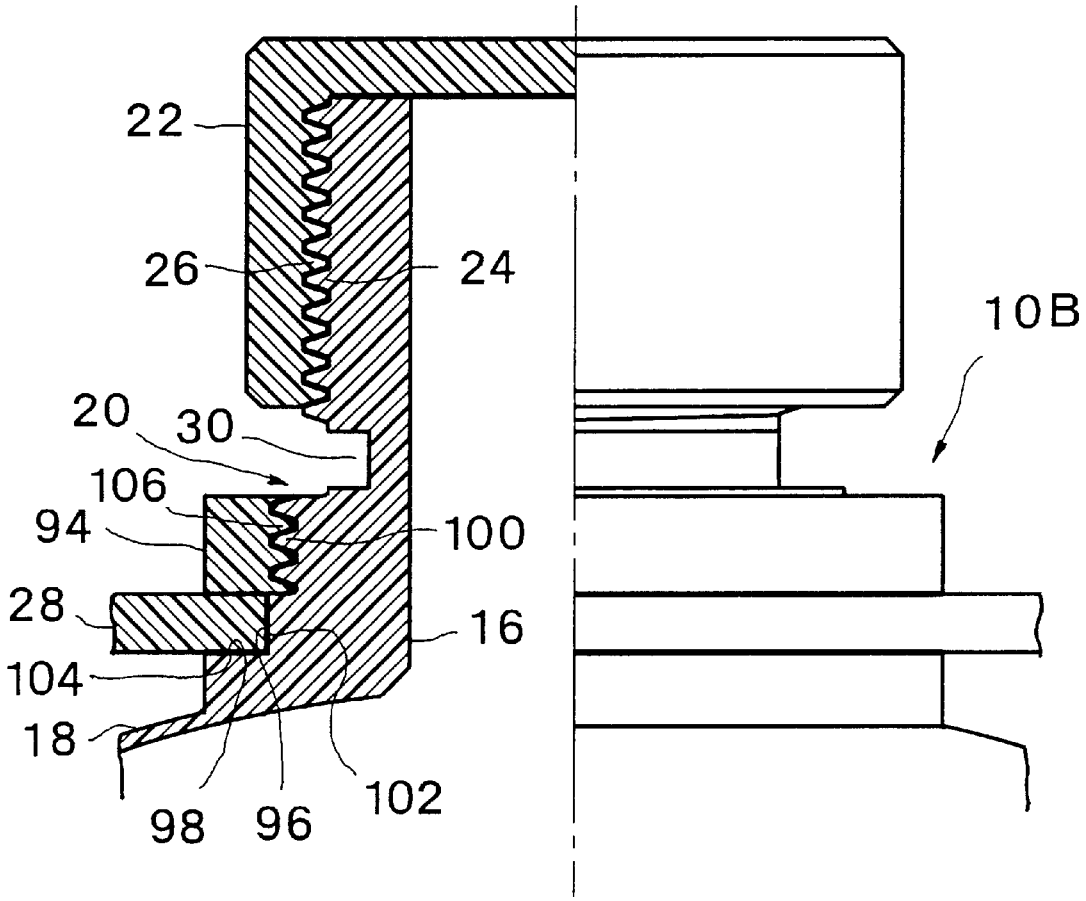
FIG. 23 is a side view partly in section of a portion around the nozzle of the ink container according to a first embodiment with regard to the disk handle mounting construction.

The disk handle 28 may be formed separately from the principal portion of the ink container including the nozzle 20 and may be mounted to the nozzle 20 by a screw ring 94, as shown in FIG. 23. In the shown embodiment, the root portion of the nozzle 20 connected with the annular end wall portion 18 is formed with a cylindrical shoulder portion 96, a flat annular shoulder portion 98 and a male screw portion 100. The disk handle 28 is formed with an opening 102 to engage the shoulder portion 96, seated on the annular shoulder portion 98 at an annular surface portion 104 around the opening, and clamped in that condition by the screw ring 94 having a female threads 106 engaged around the male threads 100.

Figure 24:
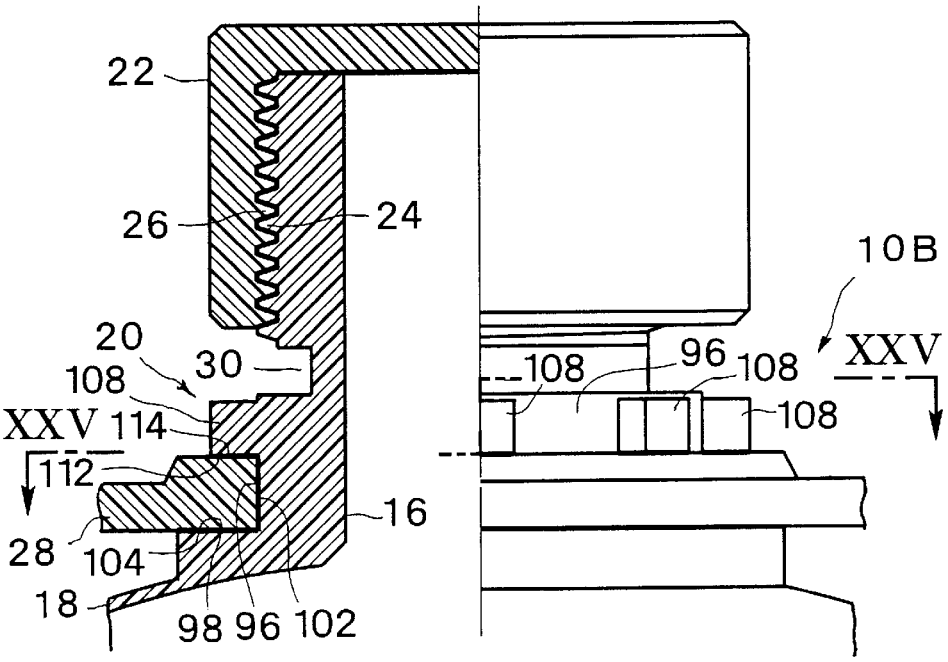
FIG. 24 is a side view partly in section of a portion around the nozzle of the ink container showing another embodiment with regard to the disk handle mounting construction.
Figure 25:
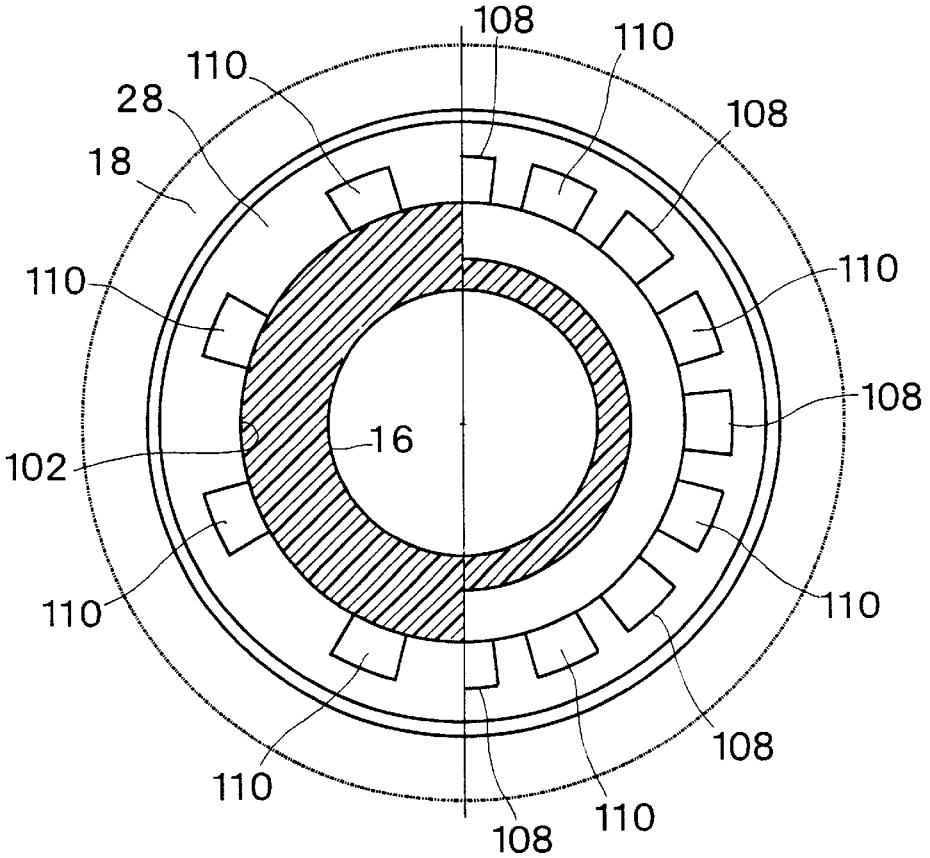
FIG. 25 is a sectional view along line XXV—XXV of FIG. 24.

The mounting of the disk handle formed separately from the nozzle may be mounted to the nozzle by a spline arrangement as shown in FIGS. 24 and 25. In this embodiment, the root portion of the nozzle 20 connected with the end wall portion 18 is formed with a cylindrical shoulder portion 96 and a flat annular shoulder portion 98 as in the embodiment shown in FIG. 23, and is further integrally formed with eight splines 108 instead of the male threads 100 in the embodiment of FIG. 23. The disk handle 28 is formed with an opening 102 for engaging with the shoulder portion 96 and eight spline grooves 110 cut in radially outwardly therefrom so as just to let the splines 108 pass therethrough.

For mounting the disk handle 28 to the nozzle 20, the disk handle 28 is fitted around the nozzle so that the opening 102 is axially aligned with the shoulder portion 96, with spline grooves 110 circumferentially aligned with the splines 108, then the disk handle is axially sloped relative to the nozzle 20 so that the splines 108 pass through the spline grooves 110 until the annular surface portion 104 abut against the shoulder portion 98, and then the disk handle 28 is turned relative to the nozzle while keeping the abutted condition until each of the spline grooves 110 is positioned between each two adjacent splines 108, whereby the disk handle 28 is axially held between the shoulder portion 98 and the eight splines 108.

Although not exhibited in the figure, an end surface 112 of each spline 102 facing the disk handle 28 may be slightly tapered such that, when the disk handle 28 is turned relative to the nozzle 20, an annular surface portion 114 of the disk handle 28 rides on the tapered surface 112 of the spline, whereby the disk handle 28 is firmly axially compressed between the shoulder portion 98 and the splines 108.

Figure 26:
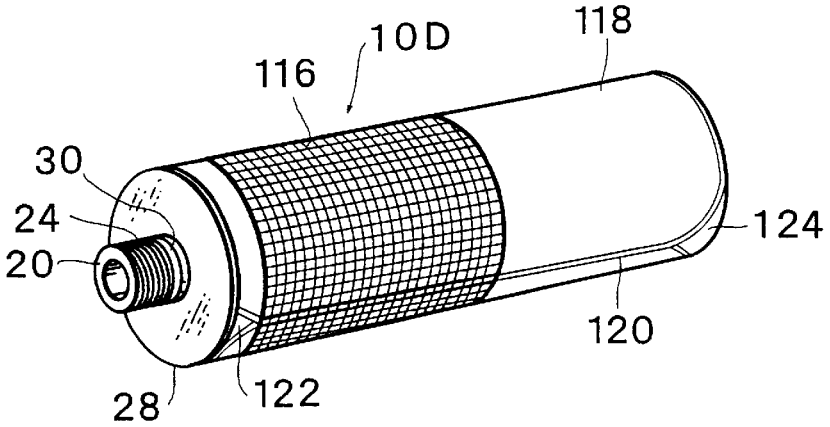
FIG. 26 is a perspective view showing a fourth embodiment of the ink container according to the present invention.
Figure 27:
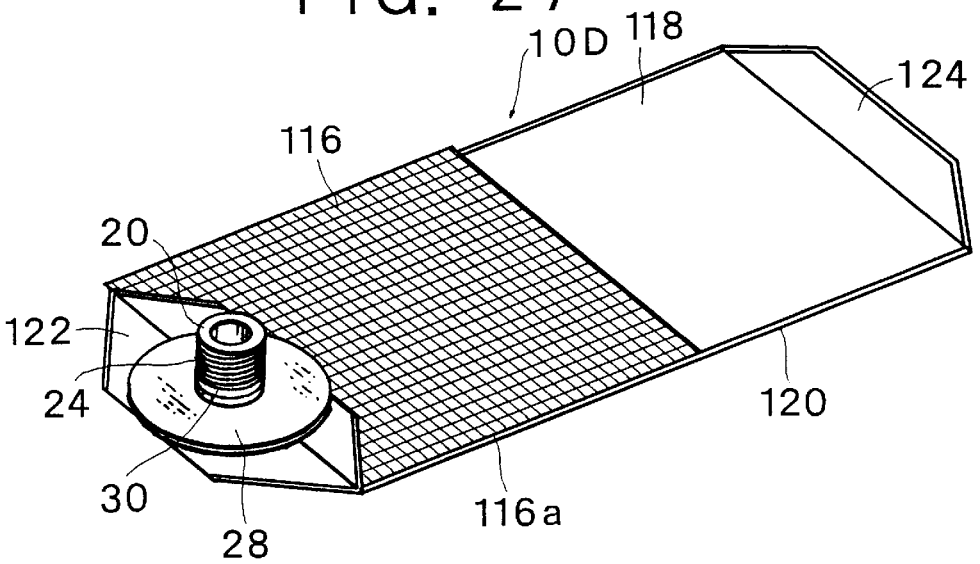
FIG. 27 is a perspective view showing the ink container of FIG. 26 in a flattened state thereof.

FIG. 26 is a perspective view showing still another embodiment in which the ink container of the present invention is constructed with a vessel of the construction proposed by the above-mentioned Japanese Patent Application 9-39712. Herein it is to be noted that an ink container 10D shown in FIG. 26 is in a condition filled with ink charged therein, and that, when the ink is discharged therefrom, the ink container is collapsed to a flat shape as shown in FIG. 27. In the ink container 10D of this fourth embodiment, the portions corresponding to those shown in the ink containers 10A, 10B and 10C of the above-mentioned first, second and third embodiments are designated by the same reference numerals as in those preceding embodiments.

In the ink container 10D of the fourth embodiment, the nozzle 20 and the disk handle 28 are constructed to have the same constructions as those of the ink container 10B of the second embodiment. In other words, the nozzle 20 is formed with an annular groove 30 adjacent to the disk handle 28 on the tip end side thereof. The nozzle 20 is connected with a vessel having a flatly collapsible cylindrical body 116 made of a relatively hard sheet material and a flatly collapsible bag 118 made of a soft sheet material and passed through the cylindrical body at a portion thereof (about a half in the shown embodiment). The inside of the bag 118 is open to the outside through the nozzle 20. The bag 118 is made of two sheets placed one over the other with peripheral portions thereof connected with one another along a seal edge 120, with opposite end portions thereof being constructed as folded portions 122 and 124, which, when the bag 118 was charged with ink, expand to construct end wall portions of a cylindrical bag, whereby a generally cylindrical vessel having a circular cross section is formed as shown in FIG. 26.

The bag 118 is fixed to the inner peripheral surface of the cylindrical body 116 along a periphery thereof at a generally axial mid portion thereof.

Figure 28:
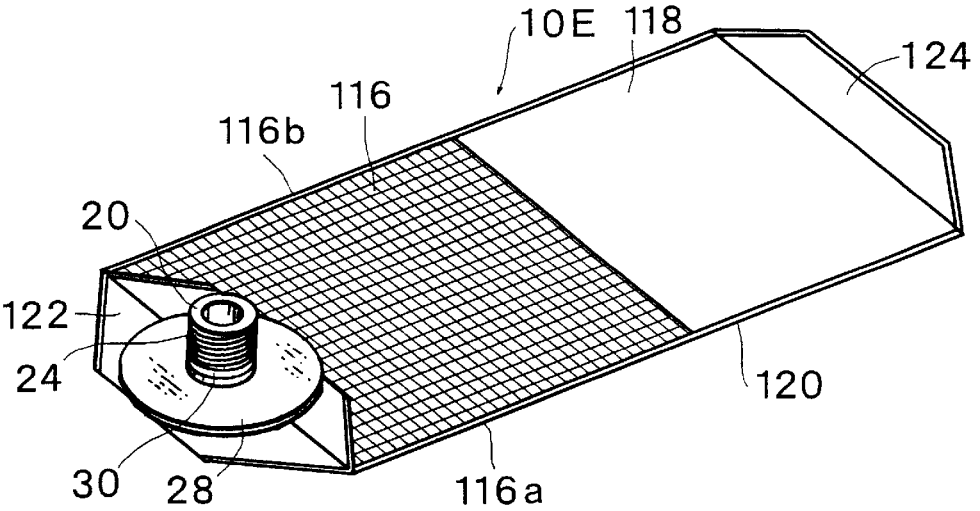
FIG. 28 is a perspective view showing a fifth embodiment of the ink container according to the present invention in a flattened state thereof.

In the fourth embodiment shown in FIGS. 26 and 27, the cylindrical body 116 is made of one sheet folded with a half thereof laid over the other half thereof and the opposite ends 116*a* are sealed together with the sheet material constructing the bag 118 so as to form the sealed edge 120 together therewith. In Japanese Patent Application 9-39712 there is shown still another construction of the vessel shown in FIG. 28, wherein the cylindrical body 116 is made of two sheets laid one over the other, with opposite overlaid edge portions 116*a* and 116*b* being sealed together with the sheet material forming the bag 118 to form the sealed edge 120 together therewith. FIG. 28 shows a fifth embodiment in which the present invention is constructed to have such a vessel. It will be apparent that the ink container 10E of the fifth embodiment presents substantially the same outer configuration as that shown in FIG. 26 when the inside thereof was filled with ink.

Figure 29:
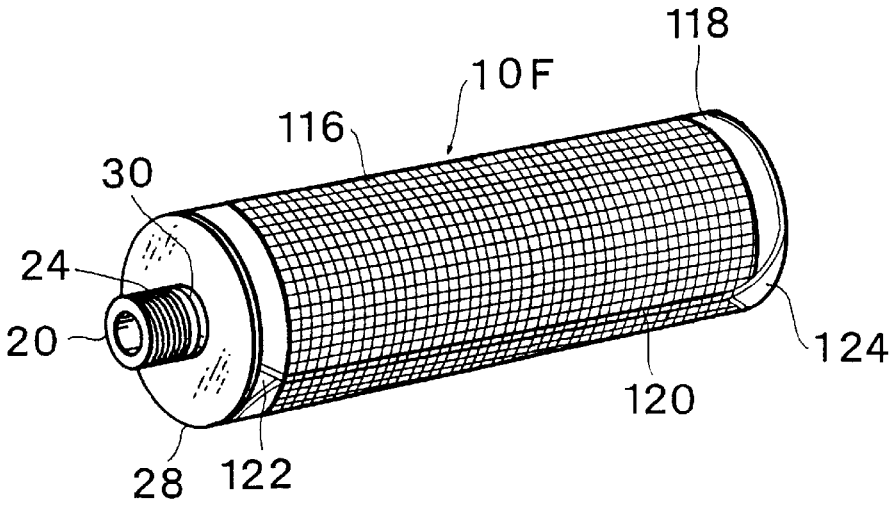
FIG. 29 is a perspective view showing a sixth embodiment of the ink container according to the present invention.
Figure 30:
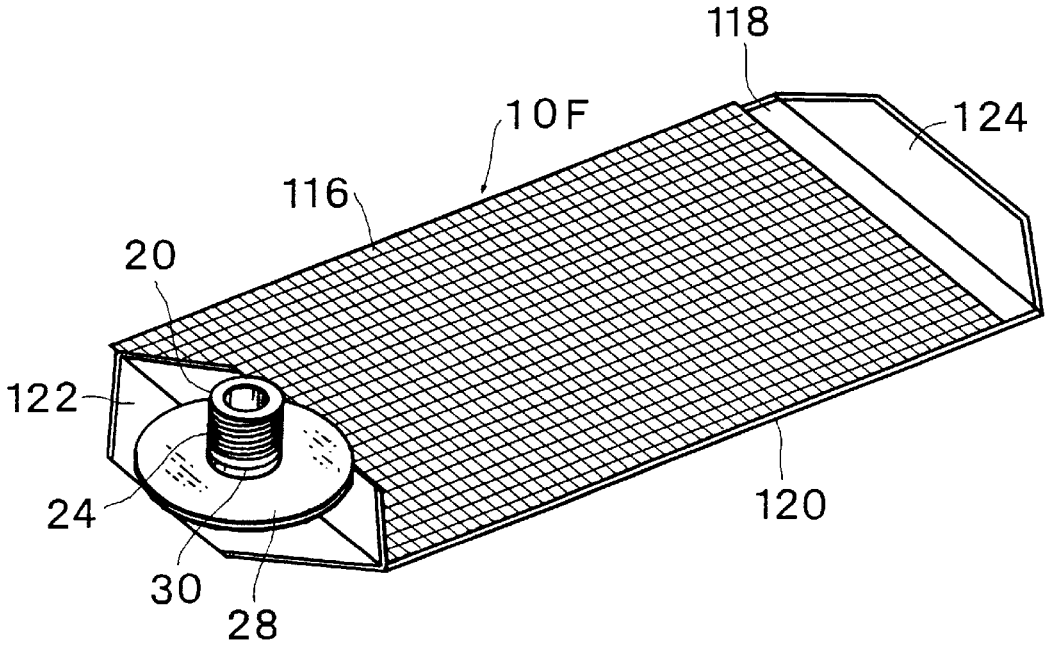
FIG. 30 is a perspective view showing the ink container of FIG. 29 in a flattened state thereof.

In the above-mentioned Japanese Patent Application 9-39712, there is also shown a construction of a vessel such as shown in FIG. 29, wherein the cylindrical body 116 is made longer so as to cover nearly the whole length of the bag 118. FIG. 29 is a perspective view similar to FIG. 26, showing a sixth embodiment, in which the present invention is embodied with such a vessel construction. FIG. 30 is a view similar to FIGS. 27 and 28, showing a condition that the ink container 10F was collapsed flatly. In this sixth embodiment, the portions corresponding to those of the fourth and fifth embodiment shown in FIGS. 26–28 are designated by the same reference numerals as in FIGS. 26–28. This sixth embodiment is different from the fourth embodiment shown in FIGS. 26 and 27 only in that the axial length of the cylindrical body 116 is made longer so as to cover nearly the whole length of the bag 118. In this sixth embodiment, the bag 118 is also fixed to the cylindrical body 116 at a generally axially mid portion thereof.

Figure 10:
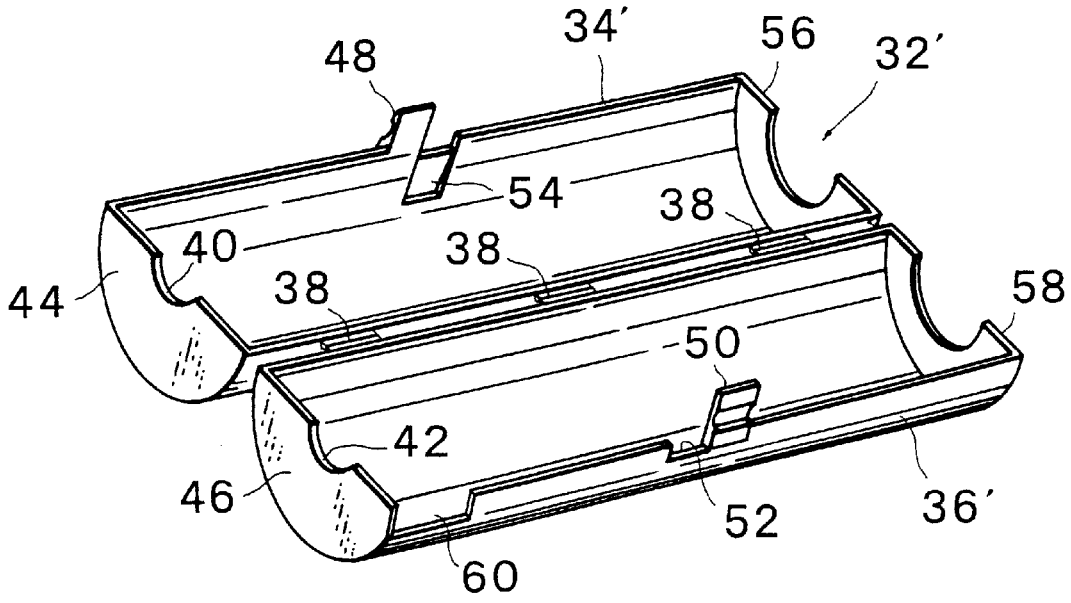
FIG. 10 is a perspective view showing a second embodiment of the case according to the present invention with a case half thereof being opened.
Figure 11:
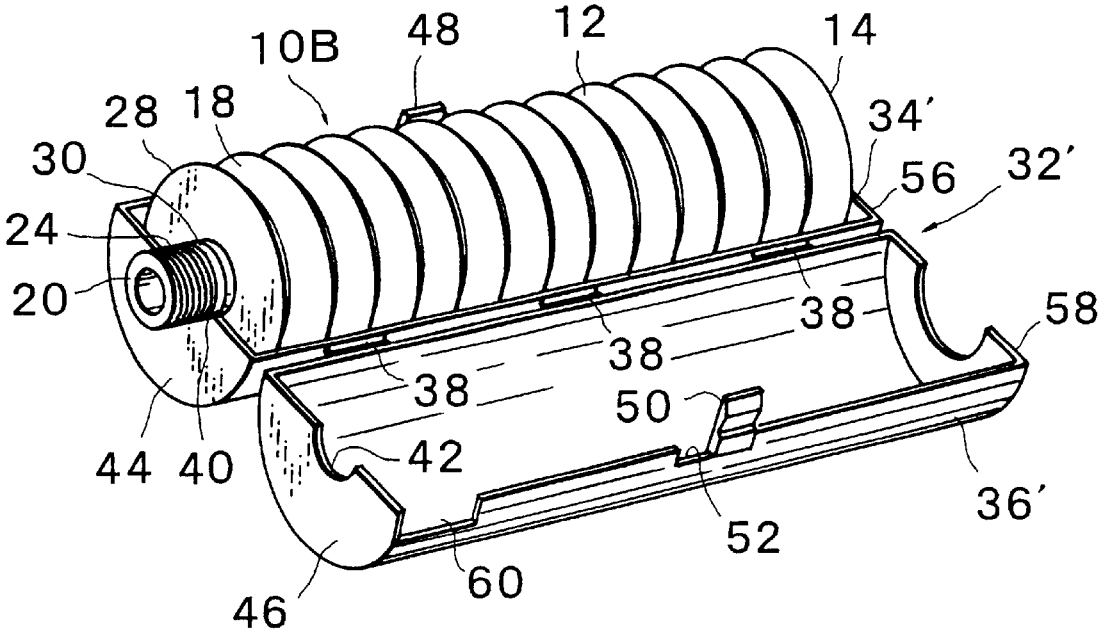
FIG. 11 is a perspective view showing the ink container shown in FIG. 9 as place in the case in the state shown in FIG. 10.
Figure 12:
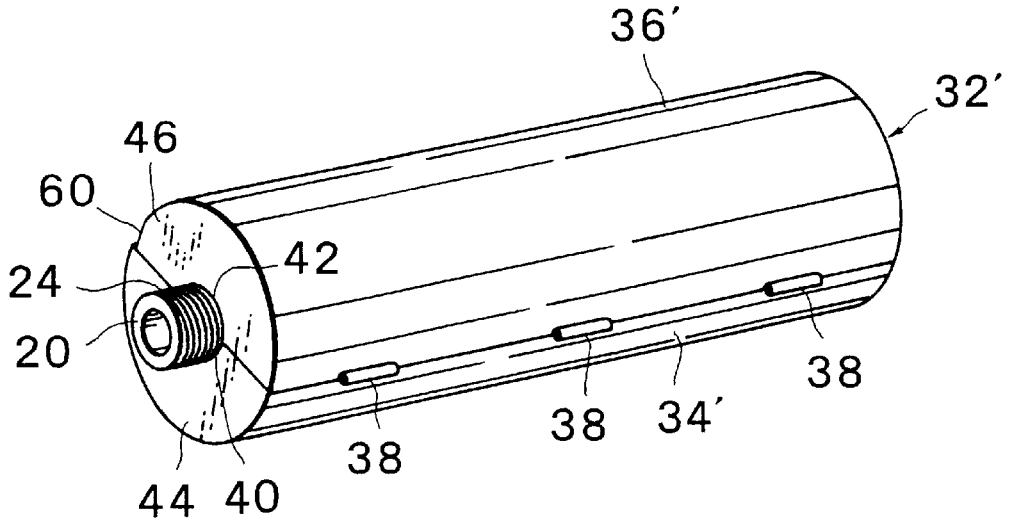
FIG. 12 is a perspective view showing the case of FIG. 10 with the ink container of FIG. 9 completely housed therein.
Figure 31:
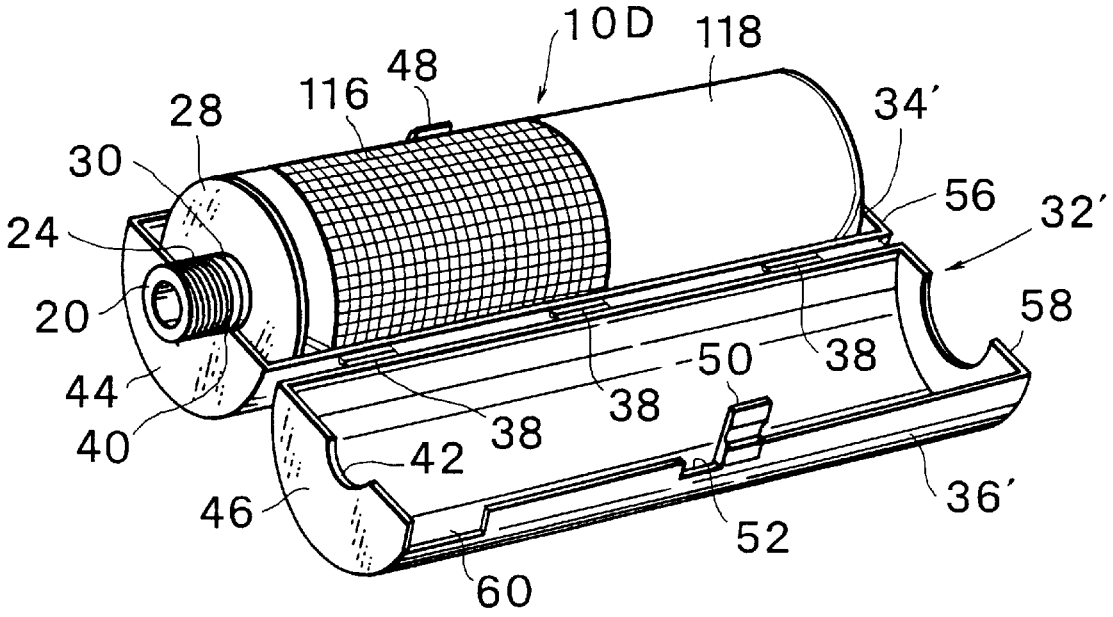
FIG. 31 is a perspective view showing the ink container of FIG. 26 as housed in the same case as that shown in FIG. 10.

FIG. 31 is a view similar to FIG. 11 in which the ink container 10D of the fourth embodiment shown in FIG. 26 was placed in the same case as that shown in FIG. 10. In FIG. 31, the portions corresponding to those shown in FIGS. 11 and 26 are designated by the same reference numerals. In this case also, when the ink container 10D is placed in the case 32' as shown in FIG. 31, and then the case half 36' is closed over the case 34', a cased ink container having exactly the same outside view as the cased ink container shown in FIG. 12 is obtained.

Figure 8:
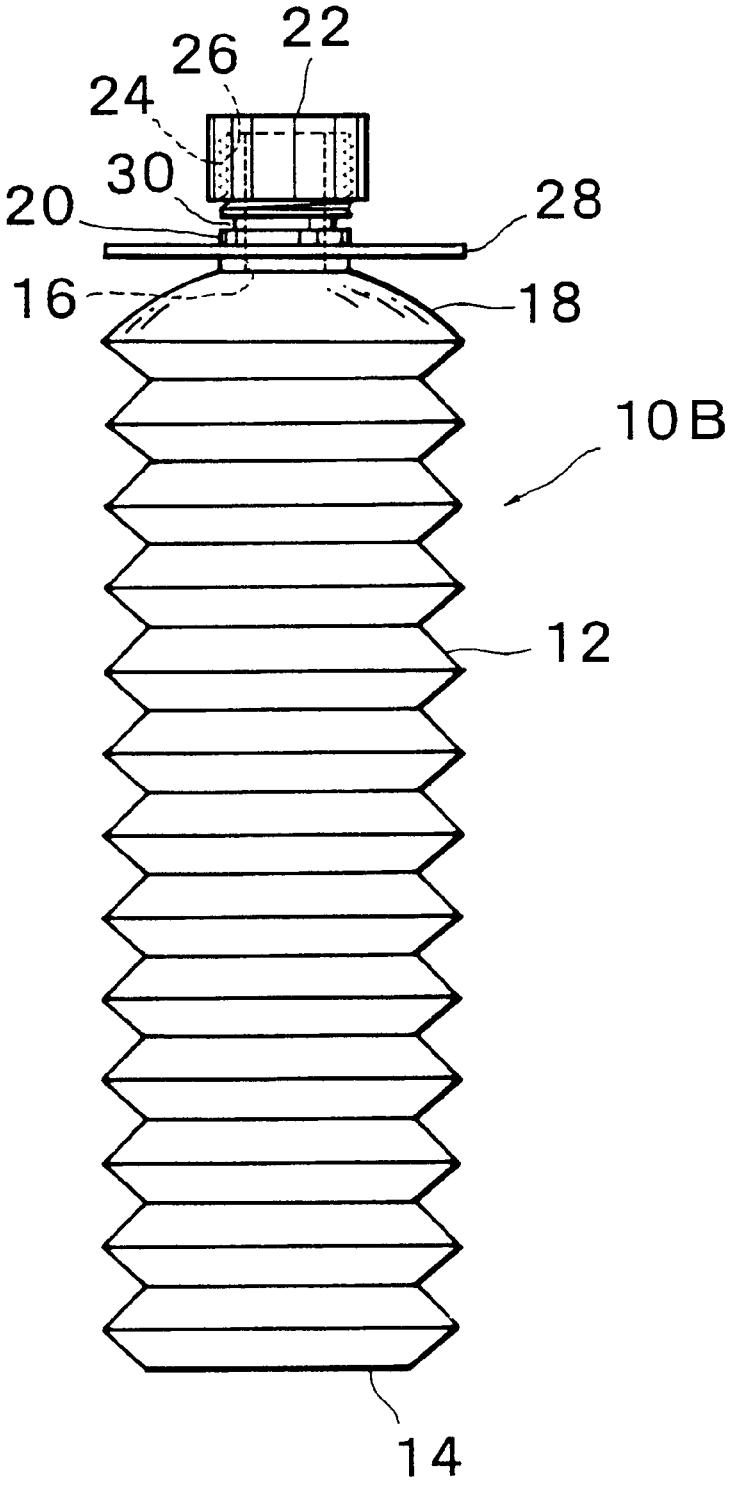
FIG. 8 is a side view showing a second embodiment of the ink container according to the present invention together with a cap.
Figure 9:
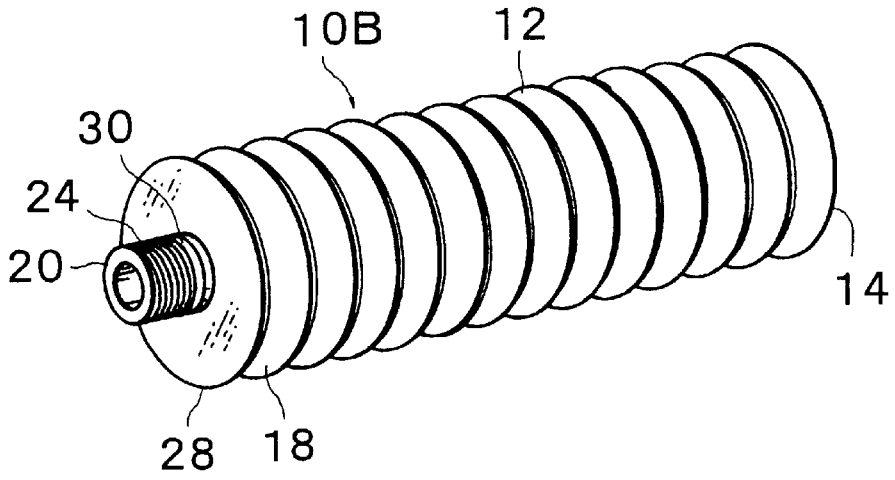
FIG. 9 is a perspective view of the ink container shown in FIG. 8.
Figure 32:
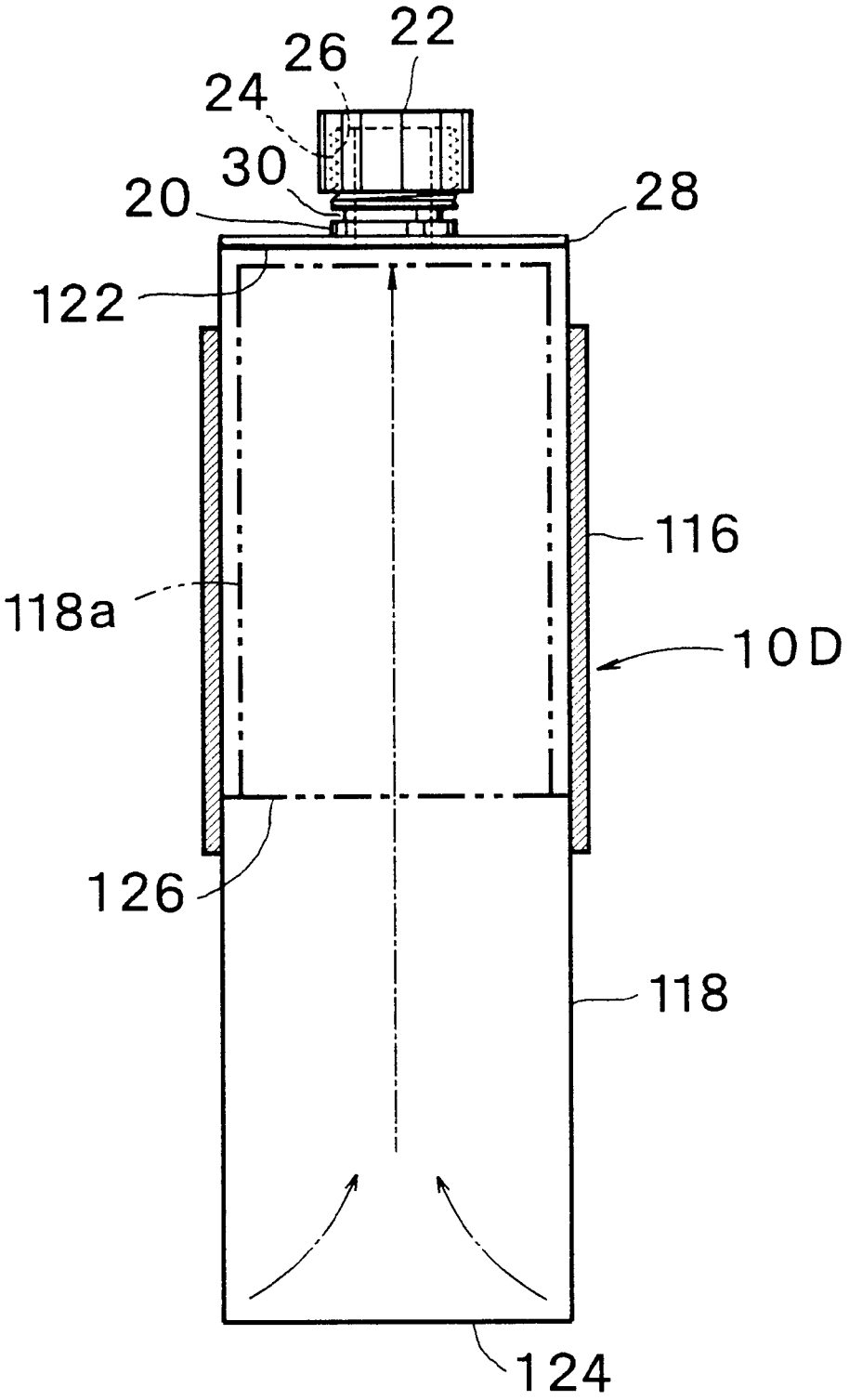
FIG. 32 is a side view of the ink container shown in FIG. 26, diagrammatically illustrating the manner of deformation of the ink container when the ink charged in the ink container has been discharged therefrom.

FIG. 32 is a side view similar to FIG. 8 with regard to the ink container 10B of the second embodiment, showing the ink container 10D of the fourth embodiment shown in FIG. 26 in the same manner as in FIG. 8, provided that in FIG. 32 the cylindrical body 116 is shown in the longitudinal cross section, and further the thickness of the sheet material constructing the cylindrical body 116 is magnified relative to the longitudinal and lateral dimensions of the ink container for the clarity of illustration. Further, the opposite end portions of the bag 118 constructed by the folded portions 122 and 124 are simplified like an end surface configuration of a simple cylindrical body. In FIG. 32, the portions corresponding to those shown in FIGS. 8 and 26 are designated by the same reference numerals as in those figures.

Further, in FIG. 32, the manner of deformation of the bag 118 according to the discharge of ink from the ink container 10D through the nozzle 20 is diagrammatically illustrated. As described above, the bag 118 is fixed at an annular portion 126 located at an axially central position thereof to the inner peripheral surface of the cylindrical body 116. Therefore, according to the progress of discharge of the ink from the bag 118 through the nozzle 20, a half portion of the bag 118 on the side opposite to the nozzle 20 is gradually drawn toward inside of the cylindrical body 116 to be finally received in the inside of the cylindrical body 116 as turned over inside out as shown by a phantom line 118*a* in the figure, so that almost all ink charged in the bag 118 is exhausted therefrom through the nozzle 20.

In the sixth embodiment shown in FIGS. 29 and 30, the bag 118 is also fixed to the inner peripheral surface of the cylindrical body 116 at a substantially axially mid position of the length thereof in the same manner as shown in FIG. 32, so that according to the progress of discharge of the ink from the bag 118, the bag is finally received within a half portion of the cylindrical body 116, with a half of the bag being turned over inside out in the same manner as shown in FIG. 32.

It will be apparent that, when the ink container of the present invention is embodied with the vessel constructed by the cylindrical body 116 and the bag 118 as shown in FIGS. 26–32, the construction with respect to the nozzle 20 and the disk handle 28 or the construction for mounting the nozzle and the disk handle to the end wall portions 44 and 46 of the case may be modified to correspond to those of the embodiments shown in FIGS. 1–7, FIGS. 14–20, FIG. 21, FIG. 22, and FIGS. 23–25.

As will be apparent from the detailed descriptions of the present invention including those of the embodiments thereof, according to the present invention the totally cylindrical container device to be charged into a printer as an ink source means is provided substantially in the same rigid cylindrical configuration as in the conventional totally rigid ink container, while nevertheless the consumption of the manufacturing material for the ink container proportional to the amount of consumption of ink and the mass and the volume of the used containers to be disposed are extremely decreased relative to those of the conventional rigid containers. In other words, according to the present invention, the case for providing a rigid container configuration as a whole remains constantly one, regardless of the amount of consumption of ink, while the containers proportional to the amount of consumption of ink constructed with vessels having a very thin wall thickness bring about the reduction of the material for manufacture to one tenth or less as compared with the conventional rigid containers. Further, the vessels contract after the consumption of the ink charged therein so that the outer volume thereof contracts to one tenth or less, thereby decreasing the bulk of the remaining containers to be disposed to one tenth or less as compared with the conventional containers.

The above-mentioned distinguished improvement with respect to the economy of the material in the manufacture of the containers as an ink source means for a printer and the issue of global environment is accomplished without substantially sacrificing the easiness of handling of the ink container by the disk handle being mounted to the nozzle for the thin and substantially contractible vessel forming the principal body of the ink container, and also without sacrificing the easiness of charging and discharging the ink source means into and out of a printer by the ink container principally constructed by the thin walled vessel being combined with the reinforcing case as housed therein.

I claim:

1. An ink container comprising a flexible vessel having axially opposite end walls and a tubular side wall provided between the end walls, said flexible vessel being expansible to be substantially cylindrical by ink being charged therein and contractible to substantially reduce an outer configuration thereof by the ink being discharged therefrom, a nozzle connected to one of said end walls of said vessel for defining an ink outlet port of said vessel, and a disk shaped handle mounted to said nozzle and separated from said one end wall, said disk shaped handle having a diameter substantially the same as that of said tubular side wall.

2. An ink container according to claim 1, wherein said disk shaped handle is formed integrally with said nozzle.

3. An ink container according to claim 1, wherein said disk shaped handle is removably mounted to said nozzle.

4. An ink container according to claim 1, wherein said disk shaped handle is provided with a projection extending axially outwardly therefrom for detection of the position of said disk shaped handle.

5. An ink supply source device for a printer assembled from an ink container comprising a flexible vessel having axially opposite end walls and a tubular side wall provided between the end walls, said flexible vessel being expansible to be substantially cylindrical by ink being charged therein and contractible to substantially reduce an outer configuration thereof by the ink being discharged therefrom, a nozzle connected to one of said end walls of said vessel for defining an ink outlet port of said vessel, and a disk shaped handle mounted to said nozzle and separated from said one end wall, said disk shaped handle having a diameter substantially the same as that of said tubular side wall, and a reinforcing case for receiving at least said vessel of said ink container.

6. An ink supply source device according to claim 5, wherein said case has a construction of two case halves being connected with each other by hinge means along longitudinal edges thereof adjacent to each other.

7. An ink supply source device according to claim 6, wherein said case halves have each an end wall for clamping said nozzle at a portion thereof located between said disk shaped handle and said end portion of said vessel.

8. An ink supply source device according to claim 6, wherein said nozzle is formed with an annular groove, and said case halves have each an end wall for clamping said nozzle by engaging into said annular groove thereof.

9. An ink supply source device according to claim 5, wherein said disk shaped handle is located inside of said case when said ink container is housed in said case, and said case is formed with an opening for allowing said disk handle being touched for detection thereof from the outside of said case.

10. An ink supply source device according to claim 5, wherein said disk shaped handle is provided with a projection, while said case is formed with an opening such that, when said ink container is housed in said case, said projection projects out of said case through said opening of said case.

11. An ink supply source device according to claim 5, wherein said vessel of said ink container presents a substantially cylindrical outer configuration of a substantially circular cross section when charged with ink, and said case has a trough portion for receiving said vessel at a portion thereof greater than a half thereof severed by an imaginary plane including a central axis thereof, and a dish-like or annular end wall portion connected with an end of said trough portion for receiving a closed end of said vessel.

* * * * *